US007502586B2

(12) United States Patent
Shimizu

(10) Patent No.: US 7,502,586 B2
(45) Date of Patent: Mar. 10, 2009

(54) AUTOMATIC DOCUMENT FEEDER, IMAGE PROCESSING APPARATUS, ORIGINAL CONVEYING METHOD, PROGRAM AND STORAGE MEDIUM

(75) Inventor: Koji Shimizu, Yokohama (JP)

(73) Assignee: Canon Kabushiki Kaisha (JP)

( * ) Notice: Subject to any disclaimer, the term of this patent is extended or adjusted under 35 U.S.C. 154(b) by 380 days.

(21) Appl. No.: 11/412,608

(22) Filed: Apr. 27, 2006

(65) Prior Publication Data

US 2006/0245802 A1 Nov. 2, 2006

(30) Foreign Application Priority Data

Apr. 28, 2005 (JP) ..... 2005-133318

(51) Int. Cl.
*G03G 15/00* (2006.01)
*B65H 85/00* (2006.01)

(52) U.S. Cl. ..... 399/367; 399/370; 399/371

(58) Field of Classification Search ..... 399/370, 399/373, 374

See application file for complete search history.

(56) References Cited

U.S. PATENT DOCUMENTS 6,354,589 B1 3/2002 Taruki et al.
6,785,488 B2 * 8/2004 Katsuyama ..... 399/84
2001/0014234 A1 * 8/2001 Kono ..... 399/370

FOREIGN PATENT DOCUMENTS

JP 2000-143104 A 5/2000

* cited by examiner

*Primary Examiner*—Daniel J Colilla
*Assistant Examiner*—Allister Primo
(74) *Attorney, Agent, or Firm*—Rossi, Kimms & McDowell, LLP

(57) ABSTRACT

An automatic document feeder which is capable of preventing the occurrence of jams that would be caused when a bundle of originals in which originals having lengths in a conveying direction equal to or greater than a predetermined reference length and originals having lengths shorter than the reference length are mixed are conveyed in a high-speed double-sided mode. When the originals are sequentially conveyed, a length of a respective original is detected. If the detected length of a preceding original being conveyed in the high-speed double-sided mode is equal to or greater than a predetermined length, the high-speed double-sided mode in which conveyance of the next original is started after start of non-reading conveyance of the preceding original is switched over to a normal double-sided mode in which the conveyance of the next original is started in advance of the non-reading conveyance of the preceding original.

7 Claims, 16 Drawing Sheets

AUTOMATIC DOCUMENT FEEDER, IMAGE PROCESSING APPARATUS, ORIGINAL CONVEYING METHOD, PROGRAM AND STORAGE MEDIUM

BACKGROUND OF THE INVENTION

1. Field of the Invention

This invention relates to an automatic document feeder used in an image processing apparatus such as a scanner or copier, an image processing apparatus equipped with the same, an original conveying method, a program for implementing the method, and a storage medium storing the program.

2. Description of the Related Art

Conventionally, there is known an image reading apparatus that is mounted on a copier and capable of reading originals based on both stationary original reading method and moving original reading method. In order to realize moving original reading, this kind of image reading apparatus is provided with an automatic document feeder that automatically conveys an original from an original tray to a sheet discharge tray via a reading position. Moving original reading is a method in which an image on an original is read by means of a read sensor such as a linear CCD when the original passes through the reading position. Further, in this type of image reading apparatus, the original tray and the sheet discharge tray are disposed one upon another, thereby enabling stationary original reading and moving original reading to be implemented using a compact configuration.

There is known an automatic document feeder operable in a double-sided reading mode that is for reading both sides of an original. In the double-sided reading mode, after reading a first side (hereunder, referred to as "front surface") of an original using the moving original reading method, the surfaces of the original are inverted (hereunder referred to as "surface inversion") to read a second side of the original (hereunder, referred to as "rear surface"), and the sides of the original are reversed again before the original is discharged, so that the original may be discharged with the orientation equal to that at the time of reading the first side of the original. In the case where both sides of respective originals are read, each original is conveyed so as to pass through the reading position three times.

Further, to enhance the efficiency of double-sided reading operations, the automatic document feeder feeds two original sheets onto a conveying path inside the automatic document feeder.

In order to further enhance the efficiency of double-sided reading operations, the automatic document feeder can operate in a high-speed double-sided mode in which the front surface of the next original is read while a surface inversion and discharge (hereunder, referred to as "non-reading conveyance") is being performed for the preceding original for which the reading of the rear surface of the preceding original has been completed. In this case, the order of originals passing through the reading position is: front surface of first sheet→rear surface of first sheet→front surface of second sheet→first sheet (non-reading conveyance)→rear surface of second sheet→front surface of third sheet→second sheet (non-reading conveyance)→rear surface of third sheet, . . . , and so forth.

Further, another automatic document feeder is known that is operable in a high-speed double-sided mode only in a case where the length in a conveying direction of the originals to undergo double-sided reading is shorter than a predetermined value. In this mode, before the preceding original passes through the reading position for the third time, the succeeding original is caused to pass through the reading position for the first time (for example, see Japanese Laid-Open Patent Publication (Kokai) No. 2000-143104 and the specification of U.S. Pat. No. 6,354,589). When the length of the originals measured in the conveying direction is equal to or greater than the predetermined value, conveying of originals is carried out in a normal double-sided mode such that the succeeding original has passed through the reading position for the first time after the preceding original passed through the reading position for the third time.

To enable conveyance of originals in the high-speed double-sided mode, the above described automatic document feeder has a conveying path length and a driving system that are enough to simultaneously and individually perform non-reading conveyance of the preceding original and reading of the front surface of the succeeding original.

In order to convey originals of different sizes in the high-speed double-sided mode, however, the driving system becomes complicated and the number of motors increases. As a result, costs rise and the apparatus size is increased.

Further, when a bundle of originals in which long length originals and short length originals are mixed are conveyed in the high-speed double-sided mode, conveyance of the originals becomes impossible during the operation and a paper jam (hereunder, referred to as "jam") occurs. In that case, the user must perform jam processing by removing the sheets in the conveying path, thus inconveniencing the user.

SUMMARY OF THE INVENTION

It is an object of the present invention to provide an automatic document feeder, an image processing apparatus, and an original conveying method which are capable of preventing the occurrence of jams that would be caused when a bundle of originals, in which one or more long length originals having lengths in a conveying direction equal to or greater than a predetermined reference length and one or more short length originals having lengths shorter than the reference length are mixed, are conveyed in the high-speed double-sided mode (second mode), and a program for implementing the method, and a storage medium storing the program.

To attain the above object, in a first aspect of the present invention, there is provided an automatic document feeder that sequentially conveys a bundle of originals including at least a preceding original and a next original to be conveyed subsequent to the preceding original and each having a first side and a second side, comprising a conveying path for sequentially conveying the originals in a conveying direction from a sheet feeding position at which to start conveying of the originals to a stacking position at which to stack the originals, via a reading position at which reading is sequentially performed for the originals, the reading position being between the sheet feeding position and the stacking position, a reconveying path that branches from the conveying path at a branching position between the reading position and the stacking position and merges with the conveying path at a merging position between the sheet feeding position and the reading position, for feeding, at the merging position, a respective one of the originals that has passed through the reading position to the conveying path, a controlling unit that performs conveyance control for the originals so as to carry out a first conveyance for sequentially conveying the originals along the conveying path from the sheet feeding position to the branching position in order to read the first side of each of the originals at the reading position, a second conveyance for conveying a respective one of the originals for which the first conveyance has been carried out along the reconveying path and the conveying path to the branching position in order to read the second side of the original at the reading position, and a non-reading conveyance for conveying a respective one of the originals for which the second conveyance has been carried out along the reconveying path and the conveying path to the stacking position, a selecting unit that selects one of a first mode in which the preceding original is conveyed by the first conveyance, the second conveyance and the non-reading conveyance, and the first conveyance for the next original is started after the preceding original passes the reading position during the non-reading conveyance, and a second mode in which the preceding original is conveyed by the first conveyance and the second conveyance, and the first conveyance for the next original is started in advance of the non-reading conveyance to be executed for the preceding original, and an original length detecting unit that detects a length of a respective one of the originals in the conveying direction, and the selecting unit selects the first mode in order to switch over from the second mode to the first mode when a length in the conveying direction of the preceding original being conveyed in the second mode is determined as being equal to or greater than a predetermined length based on a detection result of the original length detecting unit.

According to the above configuration, it is possible to prevent the occurrence of jams caused when a bundle of originals in which long length originals and short length originals are mixed are conveyed in the high-speed double-sided mode (second mode). Further, a compact configuration can be attained that can reduce production costs without making the driving system of an automatic document feeder complicated.

Preferably, the selecting unit selects the first mode when a length in the conveying direction of a top original of the bundle of originals is determined as being shorter than the predetermined length based on the detection result of the original length detecting unit, and selects the second mode when the length of the top original is determined as being equal to or greater than the predetermined length.

To attain the above object, in a second aspect of the present invention there is provided an image processing apparatus comprising the above described automatic document feeder, and an original reading unit that performs reading of each original of the bundle of originals supplied from the automatic document feeder.

To attain the above object, in a third aspect of the present invention there is provided an original conveying method for an automatic document feeder that sequentially conveys a bundle of originals including at least a preceding original and a next original to be conveyed subsequent to the preceding original and each having a first side and a second side, and comprises a conveying path for sequentially conveying the originals in a conveying direction from a sheet feeding position at which to start conveying of the originals to a stacking position at which to stack the originals, via a reading position at which reading is sequentially performed for the originals, the reading position being between the sheet feeding position and the stacking position, and a reconveying path that branches from the conveying path at a branching position between the reading position and the stacking position and merges with the conveying path at a merging position between the sheet feeding position and the reading position, for feeding, at the merging position, a respective one of the originals that has passed through the reading position to the conveying path, the original conveying method comprising a controlling step of performing conveyance control for the originals so as to carry out a first conveyance for sequentially conveying the originals along the conveying path from the sheet feeding position to the branching position in order to read the first side of each of the originals at the reading position, a second conveyance for conveying a respective one of the originals for which the first conveyance has been carried out along the reconveying path and the conveying path to the branching position in order to read the second side of the original at the reading position, and a non-reading conveyance for conveying a respective one of the originals for which the second conveyance has been carried out along the reconveying path and the conveying path to the stacking position, a selecting step of selecting one of a first mode in which the preceding original is conveyed by the first conveyance, the second conveyance and the non-reading conveyance, and the first conveyance for the next original is started after the preceding original passes the reading position during the non-reading conveyance, and a second mode in which the preceding original is conveyed by the first conveyance and the second conveyance, and the first conveyance for the next original is started in advance of the non-reading conveyance to be executed for the preceding original, and an original length detecting step of detecting a length of a respective one of the originals in the conveying direction, and in the selecting step, the first mode is selected in order to switch over from the second mode to the first mode when a length in the conveying direction of the preceding original being conveyed in the second mode is determined as being equal to or greater than a predetermined length based on a detection result in the original length detecting step.

Preferably, in the selecting step, the first mode is selected when a length in the conveying direction of a top original of the bundle of originals is determined as being shorter than the predetermined length based on the detection result in the original length detecting step, and the second mode is selected when the length of the top original is determined as being equal to or greater than the predetermined length.

To attain the above object, in a fourth aspect of the present invention there is provided a program for causing a computer to execute an original conveying method for an automatic document feeder that sequentially conveys a bundle of originals including at least a preceding original and a next original to be conveyed subsequent to the preceding original and each having a first side and a second side, and comprises a conveying path for sequentially conveying the originals in a conveying direction from a sheet feeding position at which to start conveying of the originals to a stacking position at which to stack the originals, via a reading position at which reading is sequentially performed for the originals, the reading position being between the sheet feeding position and the stacking position, and a reconveying path that branches from the conveying path at a branching position between the reading position and the stacking position and merges with the conveying path at a merging position between the sheet feeding position and the reading position, for feeding, at the merging position, a respective one of the originals that has passed through the reading position to the conveying path, the program comprising a control module for performing conveyance control for the originals so as to carry out a first conveyance for sequentially conveying the originals along the conveying path from the sheet feeding position to the branching position in order to read the first side of each of the originals at the reading position, a second conveyance for conveying a respective one of the originals for which the first conveyance has been carried out along the reconveying path and the conveying path to the branching position in order to read the second side of the original at the reading position, and a non-reading conveyance for conveying a respective one of the originals for which the second conveyance has been carried out along the reconveying path and the conveying path to the stacking position, a selection module for selecting one of a first mode in which the preceding original is conveyed by the first conveyance, the second conveyance and the non-reading conveyance, and the first conveyance for the next original is started after the preceding original passes the reading position during the non-reading conveyance, and a second mode in which the preceding original is conveyed by the first conveyance and the second conveyance, and the first conveyance for the next original is started in advance of the non-reading conveyance to be executed for the preceding original, and an original length detection module for detecting a length of a respective one of the originals in the conveying direction, and the selection module selects the first mode in order to switch over from the second mode to the first mode when a length in the conveying direction of the preceding original being conveyed in the second mode is determined as being equal to or greater than a predetermined length based on a detection result of the original length detecting module.

Preferably, the selecting module selects the first mode when a length in the conveying direction of a top original of the bundle of originals is determined as being shorter than the predetermined length based on the detection result of the original length detecting module, and selects the second mode when the length of the top original is determined as being equal to or greater than the predetermined length.

To attain the above object, in a fifth aspect of the present invention there is provided a storage medium that stores the above described program.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing a preferred embodiment thereof.

Figure 1:
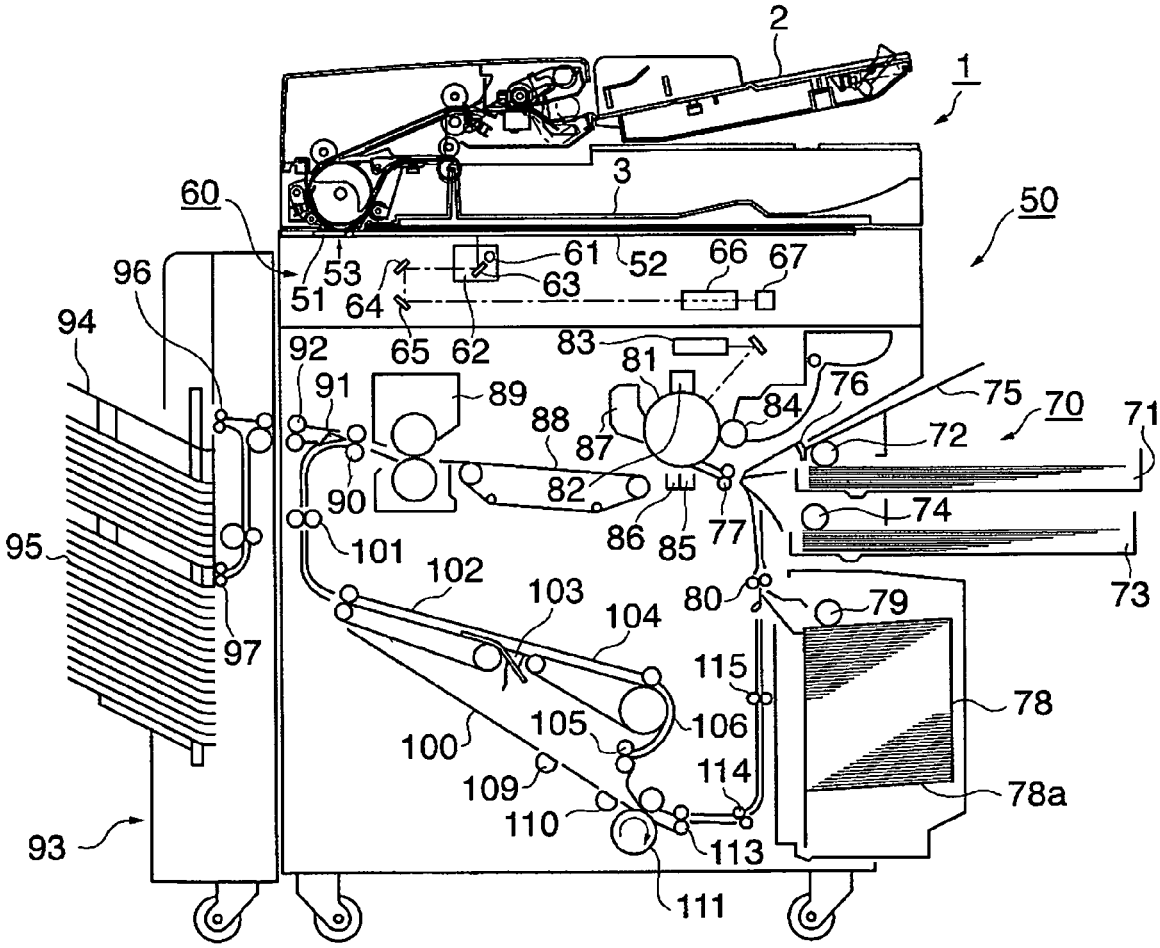
FIG. 1 is a longitudinal section schematically showing the construction of a copier as an image processing apparatus equipped with an automatic document feeder according to an embodiment of the present invention.

FIG. 1 is a longitudinal section schematically showing the construction of a copier as an image processing apparatus equipped with an automatic document feeder according to an embodiment of the present invention.

As shown in FIG. 1, the copier comprises a copier main body (hereunder, referred to as "main body") 50, and an automatic document feeder (ADF) 1 is mounted on the top of the main body 50. The automatic document feeder 1 has a stacking tray 2 on which originals to be read are stacked. A bundle of originals stacked on the stacking tray 2 are separated and fed one by one. A fed original is conveyed in the direction of a sheet discharge tray 3 via a reading position 53 on a moving original reading platen glass (platen) 51 of the main body 50, and is discharged onto the sheet discharge tray 3. When the original passes through the reading position 53, the original is scanned or read. The automatic document feeder 1 is described in detail later.

The main body 50 has a reader section 60 that reads an original and a printer section 70 that forms an image on a sheet. The reader section 60 optically reads image information that is recorded on the original, and photoelectrically converts the read image information into image data that is output. The reader section 60 is comprised of the platen 51, a book platen 52, a scanner unit 62 including a lamp 61 and a mirror 63, mirrors 64 and 65, a lens 66 and an image sensor 67 and the like.

When reading an original using the automatic document feeder 1, the scanner unit 62 scans an image on an original that is being conveyed on the platen 51, with the scanner unit 62 kept stationary directly below the reading position 53. When reading an original without using the automatic document feeder 1, the scanner unit 62 moves to scan the image on an original placed on the platen 52.

The printer section 70 forms an image on a sheet of paper using an electrophotographic process. The printer section 70 has upper and lower cassettes 71 and 73, a manual feed guide 75, and a sheet deck (tray) 78. The upper cassette 71 stores sheets (paper). Sheets stored in the upper cassette 71 are separated and fed one by one by a separation claw (not shown) and a feed roller 72 and guided to a pair of registration rollers 77. Similarly, the lower cassette 73 stores sheets. Sheets stored in the lower cassette 73 are separated and fed one by one by a separation claw (not shown) and a feed roller 74 and guided to the registration rollers 77. Sheets are fed into the manual feed guide 75 by the user, and the fed sheets are guided one by one to the registration rollers 77 through a roller 76. The sheet deck 78 comprises an intermediate plate 78*a* on which sheets are stacked. The intermediate plate 78*a* is moved up and down by a motor or the like in accordance with the height of sheets stacked thereon. Sheets stacked on the intermediate plate 78*a* are separated and fed one at a time by the operations of a feed roller 79 and a separation claw (not shown) and guided to a conveying roller 80, and then guided by the conveying roller 80 to the registration rollers 77. The registration rollers 77 feed the sheet between a photosensitive drum 81 and a transfer charger 85, described later, at a predetermined timing.

The printer section 70 has the photosensitive drum 81, and in the periphery of the photosensitive drum 81 are disposed a primary charger 82, an optical unit 83, a developing device 84, the transfer charger 85, a separation charger 86 and a cleaning device 87. The primary charger 82 uniformly charges the surface of the photosensitive drum 81. The optical unit 83 scans a laser beam to irradiate the surface of the photosensitive drum 81 in accordance with image information input from the reader section 60. An electrostatic latent image is formed on the surface of the photosensitive drum 81 by this laser beam. An electrostatic latent image formed on the surface of the photosensitive drum 81 is visualized as a toner image by toner supplied from the developing device 84.

The toner image on the photosensitive drum 81 is transferred by the transfer charger 85 onto a sheet supplied at a predetermined timing by the registration rollers 77. The sheet is then separated from the photosensitive drum 81 by the separation charger 86, and delivered to a conveying belt 88. Toner remains on the surface of the photosensitive drum 81 after the transfer is removed by the cleaning device 87.

The sheet onto which the toner image has been transferred is conveyed to a fixing device 89 via a conveying belt 88. The fixing device 89 fixes the toner image transferred on the sheet, to the sheet. The image formation onto the sheet is thereby completed. The sheet on which the image has been formed is guided by a conveying roller 90 to a discharging roller 92 via a diverter 91, and is then conveyed into a sorter 93 by the discharging roller 92. The sorter 93 has a non-sort tray 94, a sort bin tray 95, a non-sort tray discharging roller 96, and a sort bin tray discharging roller 97. When sorting sheets, the non-sort tray 94 and the sort bin tray 95 ascend and descend so that the sheets are sorted and discharged into a corresponding one or ones of the trays. In some case, a sheet discharge tray that is similar to the non-sort tray 94 is provided at an outlet of the main body 50 in place of the sorter 93.

When performing double-sided copying or multiple copying, a sheet onto which an image has been fixed is sent to a conveying roller 101 by the diverter 91, and is then conveyed by the conveying roller 101. In the case of double-sided copying, the sheet conveyed by the conveying roller 101 is temporarily discharged onto an intermediate tray 100 via belts 102 and 104, a path 106, and a discharging roller 105. The sheet that has been discharged onto the intermediate tray 100 is fed from the intermediate tray 100 by semicircle rollers 109 and 110 and a pair of separation rollers 111, and then conveyed to the registration rollers 77 by conveying rollers 113, 114 and 115.

Figure 2:
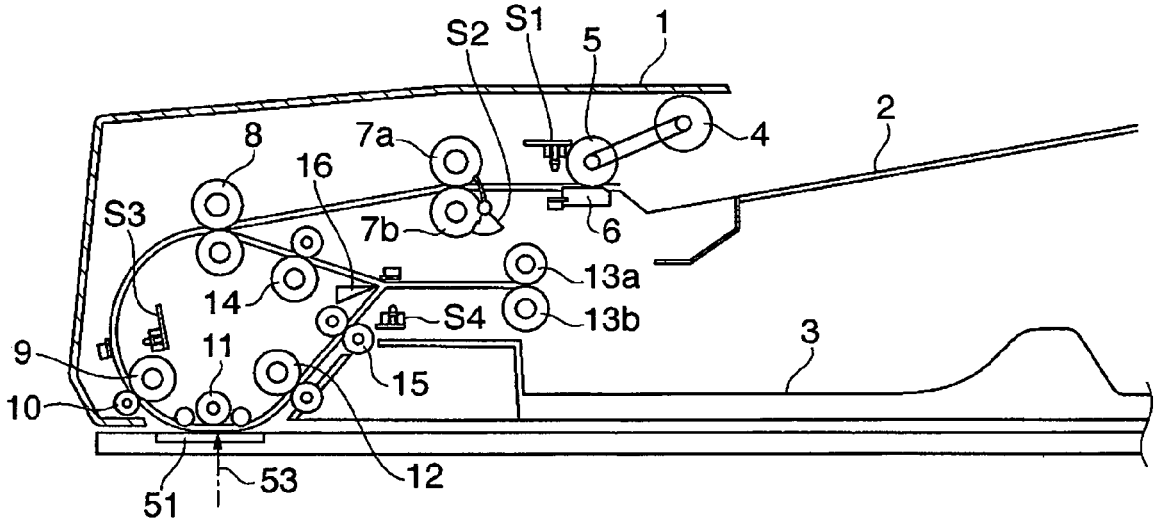
FIG. 2 is a longitudinal section view showing in detail the construction of the automatic document feeder shown in FIG. 1.
Figure 3:
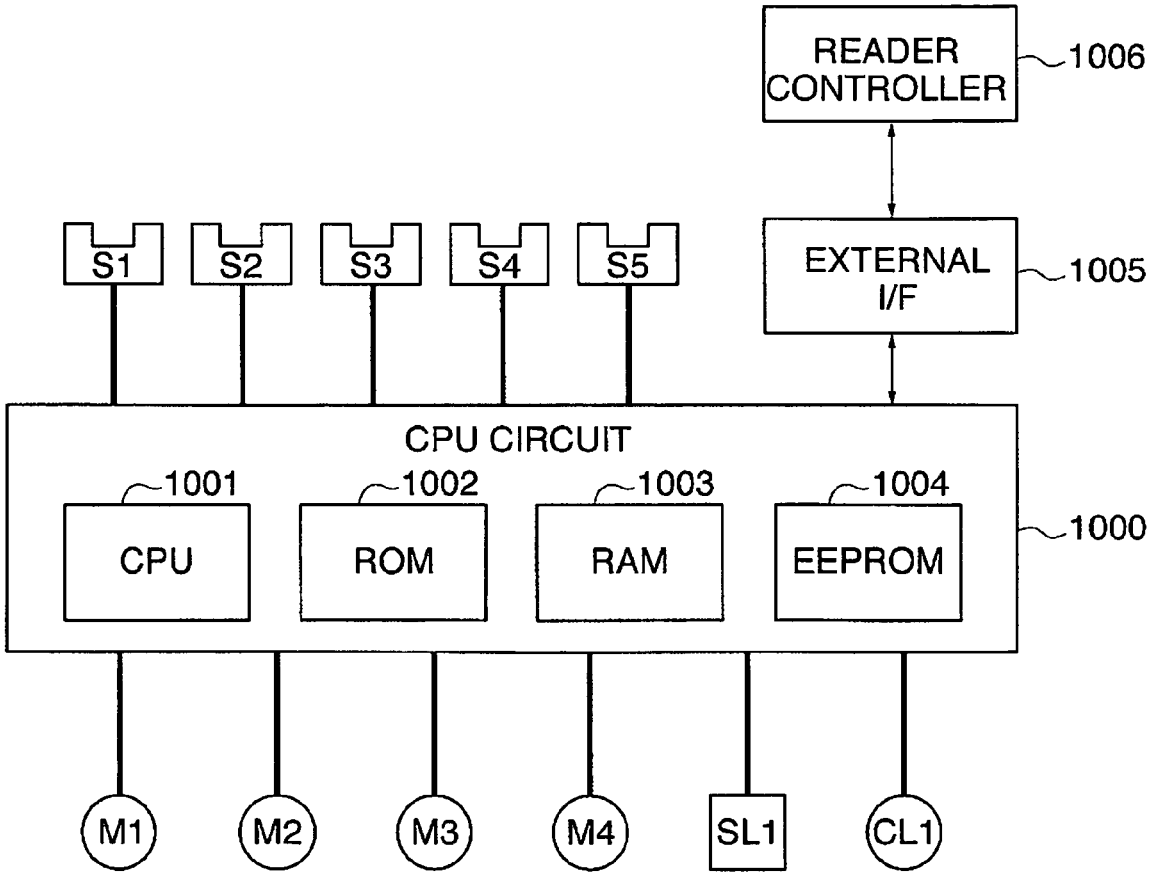
FIG. 3 is a block diagram showing a control system of the automatic document feeder shown in FIG. 2.

Next, the automatic document feeder 1 shown in FIG. 1 will be described in detail with reference to FIGS. 2 and 3. FIG. 2 is a longitudinal section view showing in detail the construction of the automatic document feeder 1, and FIG. 3 is a block diagram showing a control system of the automatic document feeder 1.

The automatic document feeder 1 according to the present embodiment conveys originals in one of a single-sided reading mode that reads image information recorded on one side of a single-sided original while conveying the original, and a double-sided reading mode that reads image information on each side of a double-sided original while conveying the original. The single-sided original has image information recorded on one side thereof, whereas the double-sided original has image information recorded on both sides thereof. In a double-sided reading mode, either a normal double-sided mode (first mode) or a high-speed double-sided mode (second mode) is selected for conveyance of originals in accordance with the length of the top original, i.e. the first original in the bundle of originals, measured in the conveying direction (hereunder, referred to as "length"). The normal double-sided mode and high-speed double-sided mode will be described in detail hereafter.

As shown in FIG. 2, the automatic document feeder 1 has a stacking tray 2 on which a bundle of originals are stacked. The automatic document feeder 1 includes four sections, i.e., an original feeding section, an original conveying section, an original discharging section, and an original inverting section. The original feeding section has a conveying path that extends from the stacking tray 2 to a pair of first registration rollers 7*a* and 7*b*. In this original feeding section, the uppermost original of the bundle of originals stacked on the stacking tray 2 is drawn by a drawing roller 4 in between feed roller 5 and a friction separation pad 6 so that the uppermost original is separated from the bundle of originals and sent towards the first registration rollers 7*a* and 7*b*. The first registration rollers 7*a* and 7*b* stop rotating when the leading edge of the original arrives at these rollers, and the leading edge of the fed original is abutted on the first registration rollers 7*a* and 7*b*. In this abutment state, conveyance of the original is performed by the feed roller 5, and a loop is formed in the original. The original thereby undergoes skew correction, and thereafter the original is sent to the original conveying section by the first registration rollers 7*a* and 7*b*.

The original conveying section has a conveying path that extends from a pair of second registration rollers 8 to a pair of third read rollers 15 via the reading position 53. In the original conveying section, an original conveyed from the original feeding section is conveyed so as to pass over the platen 51 at a predetermined speed by the second registration rollers 8, a pair of first read rollers 9 and 10, and a platen roller 11. Further, a pressing/releasing motor M4 (see FIG. 3) is driven before the leading edge of the original arrives at the first read rollers 9 and 10. As a result, in the first read rollers 9 and 10, the roller 9 is pressed against the roller 10 at a predetermined pressure. In this state, the original is conveyed. At this time, the scanner unit 62 (see FIG. 1) is positioned underneath the reading position 53 on the platen 51, and carries out an exposure operation (read operation). While this exposure operation is underway, the first read rollers 9 and 10 are gradually separated. This is performed by driving of the releasing motor M4 before the trailing edge of the original passes between the first read rollers 9 and 10. At this time, the leading edge of the original passes between a pair of second read rollers 12 and the third read rollers 15, whereby conveying of the original is performed by these rollers 12 and 15.

The original discharging section has a conveying path that extends from the third read rollers 15 to the sheet discharge tray 3 via a pair of discharge/inversion rollers 13*a* and 13*b*. In the original discharging section, while an exposure operation is being performed at the reading position 53, the discharge/inversion rollers 13*a* and 13*b* are in a separated state. Then, after the trailing edge of the original passes through the reading position 53 to complete reading of that original, a solenoid SL1 (see FIG. 3) is turned on and the discharge/inversion roller 13*b* is moved upward. Thereby, a nip is formed for pinching and conveying the original between the discharge/ inversion rollers 13*a* and 13*b*. The original is conveyed towards the sheet discharge tray 3 by this nip, and is discharged to the sheet discharge tray 3 in a state where the front surface thereof faces downward (face-down state). Further, in a double-sided reading mode as described later, the discharge/inversion rollers 13*a* and 13*b* are driven in reverse in order to switchback the original and send it to the original conveying section once again.

The original inverting section has a conveying path that branches from the conveying path of the original conveying section at a position between the position of the third read rollers 15 and the position of the discharge/inversion rollers 13*a* and 13*b*, and extends to a position short of (upstream of) the second registration rollers 8. An inversion flapper 16 is provided at the position where the conveying path of the original inverting section branches from that of the original discharging section. An inverting roller 14 is provided at a position partway along the conveying path of the original inverting section. When the conveyance is performed in the double-sided reading mode, inversion of the surfaces to be read (front and rear surfaces) of the original (hereunder, referred to as "surface inversion") is carried out by temporarily guiding to the original inverting section an original that has once been conveyed to the original discharging section. This operation to invert the surfaces of an original in the original inverting section is described later.

A size sensor S1 that detects the leading edge and trailing edge of an original that is being conveyed is provided at a position downstream of the feed roller 5. Further, a registration sensor S2 that detects the leading edge of an original is provided at a position short of the first registration rollers 7*a* and 7*b*. A read sensor S3 that detects the leading edge and trailing edge of an original is provided at a position short of the first read rollers 9 and 10. The read sensor S3 inputs a signal as a scan (read) starting signal to the reader section 60 of the main body 50. A discharge sensor S4 that detects the leading edge and trailing edge of an original is provided at a position downstream of the third read rollers 15. Further, an original set sensor S5 that detects the presence or absence of originals on the stacking tray 2 is provided in the stacking tray 2 (see FIG. 3). As described later, in order to determine the length L of an original in a conveying direction, the size sensor S1 detects the trailing edge of an original and the read sensor S3 detects the leading edge of the original.

As shown in FIG. 3, the control system for the automatic document feeder 1 mainly has a CPU circuit 1000. The CPU circuit 1000 includes a CPU 1001 that carries out overall control of the automatic document feeder 1, a ROM 1002, a RAM 1003, and an EEPROM 1004. The ROM 1002 stores data and programs to be executed by the CPU 1001. The RAM 1003 temporarily holds control data and is used as a work area for computational processes when the CPU 1001 executes the control programs and the like.

An external I/F (interface) 1005 that enables communication with a reader controller 1006 of the reader section 60 is connected to the CPU circuit 1000. The CPU circuit 1000 is connected to each of the sensors S1 to S5. Based on signals input from the reader controller 1006 via the external I/F 1005 and the output of each of the sensors S1 to S5, the CPU circuit 1000 controls original conveying operations, detects the state of the automatic document feeder 1 and notifies the detection result to the reader controller 1006 through the external I/F 1005. The CPU circuit 1000 is also connected to each of motors M1 to M4, the solenoid SL1, and an electromagnetic clutch CL1, and performs driving control for these. The motor M1 is a separation and feeding motor for driving the drawing roller 4, the feed roller 5, and the first registration rollers 7*a* and 7*b*, and the like. The motor M2 is a read motor for driving the second registration rollers 8, the first read rollers 9 and 10, the platen roller 11, the second read rollers 12, and the third read rollers 15 in the original conveying section. The motor M3 is a discharge/inversion motor for driving the discharge/inversion rollers 13*a* and 13*b* and the inverting roller 14 in a forward and a reverse rotation direction. The motor M4 is the pressing/releasing motor for applying pressure or releasing the pressure applied to the roller 10 by the roller 9 in the first read rollers 9 and 10. The solenoid SL1 is for moving the discharge/inversion roller 13*b* in upward and downward directions.

In the automatic document feeder 1, at the time of a single-sided reading mode, originals stacked on the stacking tray 2 with the front surface (first surface) facing upward are separated one at a time by the original feeding section and fed to the original conveying section. In the original conveying section, the original passes through the reading position 53 on the platen 51 and is conveyed towards the sheet discharge tray 3. The single-sided original is then stacked on the sheet discharge tray 3 in a state where the front surface thereof faces downward (face-down state).

In a double-sided reading mode, originals are conveyed in either a normal double-sided mode or a high-speed double-sided mode whichever is selected as the original conveying mode in accordance with the length L of the top original (the length in the conveying direction). More specifically, the length L of the top original is determined when that original is fed. If the thus determined length L of the top original is longer than a reference length, the normal double-sided mode is selected. In contrast, when the length L of the top original is shorter than the reference length, the high-speed double-sided mode is selected.

The normal double-sided mode is a mode in which: a first conveyance operation is performed by the original conveying section to convey the preceding original to the reading position 53 and read the front surface (first side) of the preceding original; after the preceding original has been subjected to surface inversion by the original inverting section following the first conveyance operation, a second conveyance operation is performed by the original conveying section to convey the preceding original to the reading position 53 and read the rear surface (second side) thereof; after the preceding original has been subjected to surface inversion by the original inverting section following the second conveyance operation, non-reading conveyance is performed to convey the preceding original to the original discharging section via the original conveying section and discharge the preceding original; and after the preceding original has passed through the reading position 53 during the non-reading conveyance, the first conveyance operation starts for the next original. Accordingly, in the normal double-sided mode according to the present embodiment, it is possible to simultaneously and sequentially feed two original sheets into the conveying paths of the automatic document feeder 1.

In contrast, the high-speed double-sided mode is a mode in which the preceding original is conveyed by the first and second conveyance operations, and the first conveyance operation for the next original is started before the preceding original passes the reading position 53 during the non-reading conveyance.

In this embodiment, a method for determining the original length L is employed that determines the original length based on a count acquired by counting a clock of the read motor M2 from the time the leading edge of the original arrives at the read sensor S3 to turn on the read sensor S3 until the time the trailing edge of the original arrives at the size sensor S1 to turn off the size sensor S1. When the size sensor S1 turns off earlier than the read sensor S3 turns on in determining the original length, the clock of the read motor M2 is counted from the time the size sensor S1 turns off until the time the read sensor S3 turns on. The aforementioned reference length is equal to a conveying length that extends from the second registration rollers 8 to the discharge/inversion rollers 13*a* and 13*b* via the first read rollers 9 and 10, the platen roller 11, the second read rollers 12, and the third read rollers 15. This conveying length is the maximum value below which the first conveyance operation for the next original is permitted to start prior to non-reading conveyance of an original for which the first and second conveyance operations have been made in the high-speed double-sided mode. In the present embodiment, since a jam occurs in the high-speed double-sided mode when the original length L is equal to or greater than the reference length, a configuration is adopted whereby when the original length L is equal to or greater than the reference length, execution of operation in the high-speed double-sided mode is disabled and operation in the normal double-sided mode is executed.

In double-sided reading mode, initially, the first original (top original) among a bundle of originals stacked in the stacking tray 2 is separated by the original feeding section, and conveyed to the original conveying section. At this time, the length of the first original is determined by the aforementioned method. When the original length is longer than the reference length, the normal double-sided mode is selected as the original conveying mode, and the original conveyance operation according to the normal double-sided mode is performed.

When the normal double-sided mode is selected as the original conveying mode, the first conveyance operation is initially performed. In the original conveying section, as in the single-sided reading mode, the first original fed from the original feeding section is conveyed so as to pass over the platen 51 at a predetermined speed. At this time, the scanner unit 62 is positioned underneath the reading position 53 on the platen 51, and carries out an exposure operation (read operation) for the front surface of the first original. At this time, an operation to separate the first read rollers 9 and 10 is performed. The first original is then guided to the original discharging section by the inversion flapper 16, and is conveyed towards the sheet discharge tray 3 by the nip formed between the discharge/inversion rollers 13*a* and 13*b*.

Next, after the trailing edge of the first original passes the discharge sensor S4, the discharge/inversion 13*a* and 13*b* are temporarily stopped and then driven in reverse, and the orientation of the inversion flapper 16 is switched. The second conveyance operation is then performed. More specifically, the first original is switched back and conveyed towards the inverting roller 14 and the second registration rollers 8 of the original inverting section, which are located in the opposite direction to the discharging direction. The second registration rollers 8 are stopped to rotate when the leading edge (trailing edge before the switchback) of the first original arrives at these rollers, and after a skew correction is performed for the first original, the second registration rollers 8 feed the first original towards the reading position 53. The skew correction is performed by forming a loop in the original by driving the inverting roller 14, with the leading edge of the original abutted on the second registration rollers 8. Further, an operation to press together the first read rollers 9 and 10 is performed during the skew correction. In the original conveying section, an exposure operation is performed for the rear surface of the first original in a similar manner to the front surface of the original, and the first original is then conveyed to the original discharging section. At this time also, an operation to separate the first read rollers 9 and 10 is performed.

If the first original conveyed to the original discharging section after the rear surface of the original is read is permitted to be discharged to the sheet discharge tray 3, the discharged original will be in a face-up state (in which the front surface faces upward). Hence, it is necessary to subject the original to surface inversion once more before discharging the original to the sheet discharge tray 3. For this reason, non-reading conveyance is performed.

In order to perform this non-reading conveyance, after the trailing edge of the first original passes the discharge sensor S4 in the original discharging section, the discharge/inversion rollers 13*a* and 13*b* rotate in reverse to convey the first original towards the original conveying section again via the original inverting section. At this time, only an operation to switchback and convey the first original is performed in the original inverting section in order to discharge the original in a face-down state, and a skew correction by the second registration rollers 8 need not be carried out. Having passed through the original conveying section, the first original is again conveyed to the original discharging section and pinched between the discharge/inversion rollers 13*a* and 13*b* and fed onto the sheet discharge tray 3. Thereby, the first original is discharged in a state where the front surface thereof faces downward, i.e. in a face-down state.

When there is a next original (second original) on the stacking tray 2, the next original is conveyed to the original conveying section after the preceding original (first original) has passed the reading position 53 during the non-reading conveyance. After the front surface of the next original is read, the second conveyance operation and non-reading conveyance are performed in a similar manner to the first original.

When the length of the top original determined as described above is shorter than the reference length, the high-speed double-sided mode is selected as the original conveying mode, and the original conveyance operation according to this mode is performed. The high-speed double-sided mode will now be described with reference to FIGS. 4A to 7B. FIGS. 4A to 7B are views showing an example of the conveying state of originals in the high-speed double-sided mode in the automatic document feeder 1 of FIG. 2. The example illustrated in FIGS. 4A to 7B shows a case in which two original sheets P1 and P2 are conveyed in the high-speed double-sided mode. In each drawing, a triangular mark (Δ mark) is added to each original as an indicator to represent the front surface and the leading edge of the original. In this example, a case is described in which two original sheets to be conveyed in the high-speed double-sided mode are the same in size.

As described above, the first original P1 (top original) fed from the stacking tray 2 by the original feeding section is conveyed to the original conveying section. When the first original P1 passes the reading position 53, the front surface of the first original P1 is scanned or read by the scanner unit 62. When the trailing edge of the first original P1 passes the read sensor S3 during the scanning operation for the front surface of the first original P1, the second original P2 is fed and then waits at the position of the first registration rollers 7*a* and 7*b* (see FIG. 4A). During this waiting period, a loop is formed in the original P2 at the position of the first registration rollers 7*a* and 7*b*, whereby the skew correction is made. The length of the original P1 is also determined at this time.

Figure 4A:
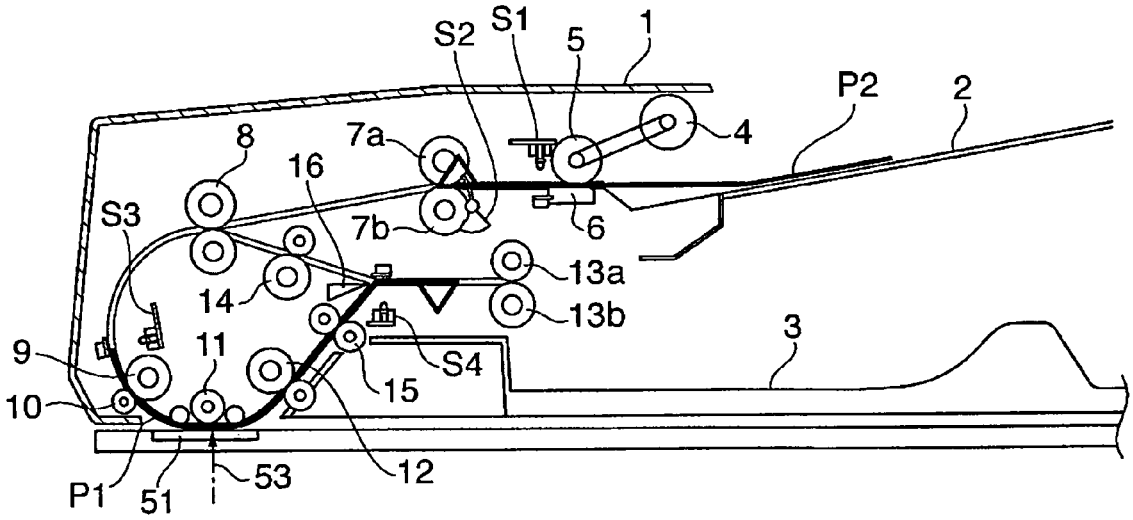
FIGS. 4A and 4B are views showing an example of how originals are conveyed in a high-speed double-sided mode of the automatic document feeder shown in FIG. 2.
Figure 4B:
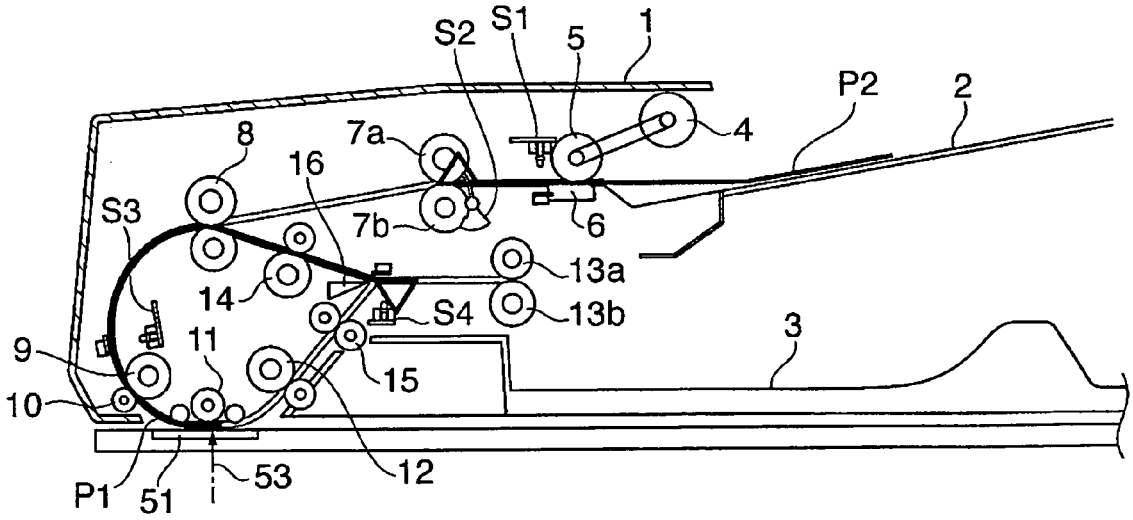
Figure 5A:
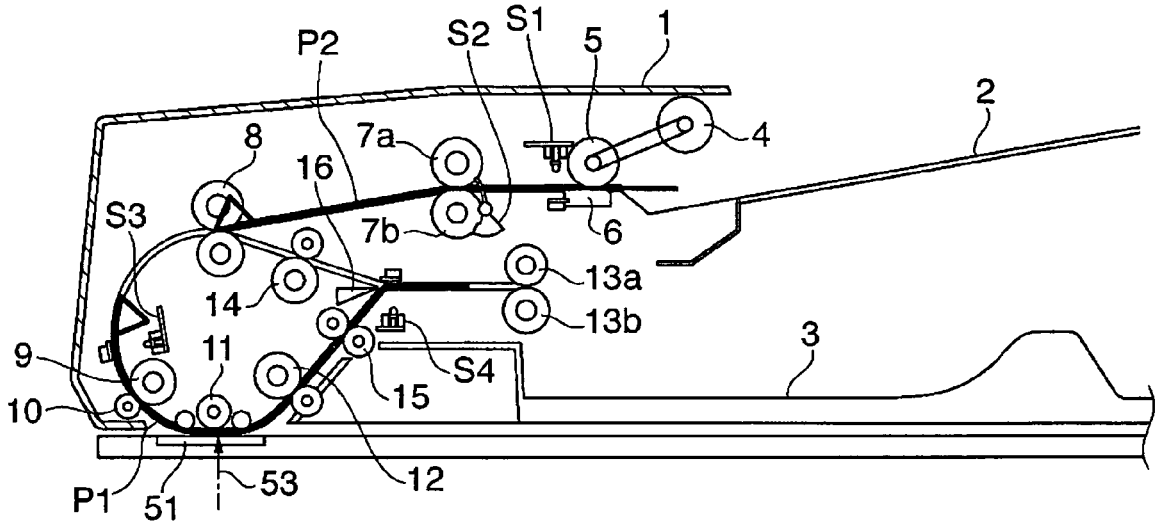
FIGS. 5A and 5B are views showing the originals further conveyed from the positions shown in FIG. 4B.
Figure 5B:
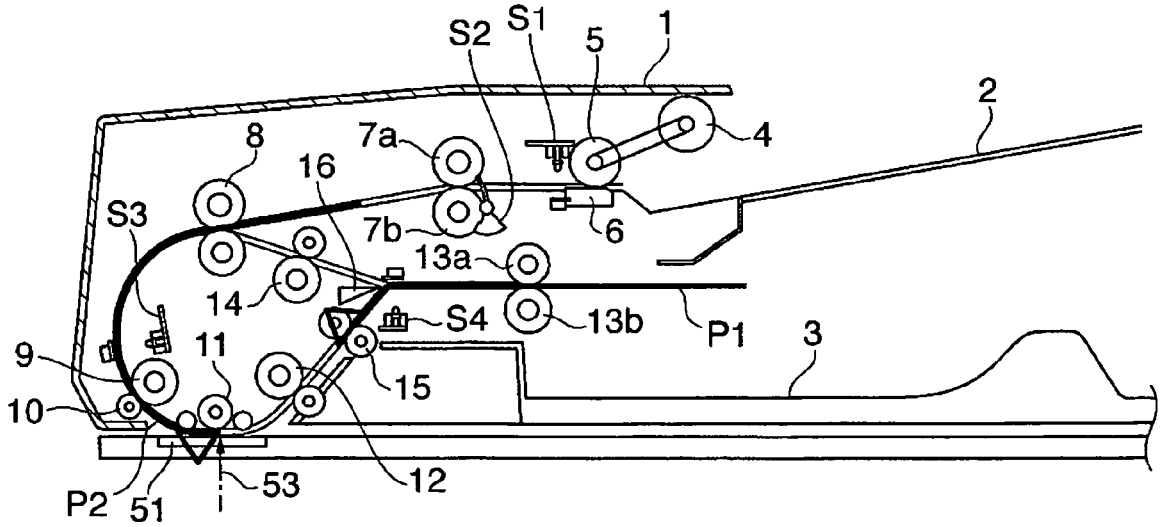
Figure 6A:
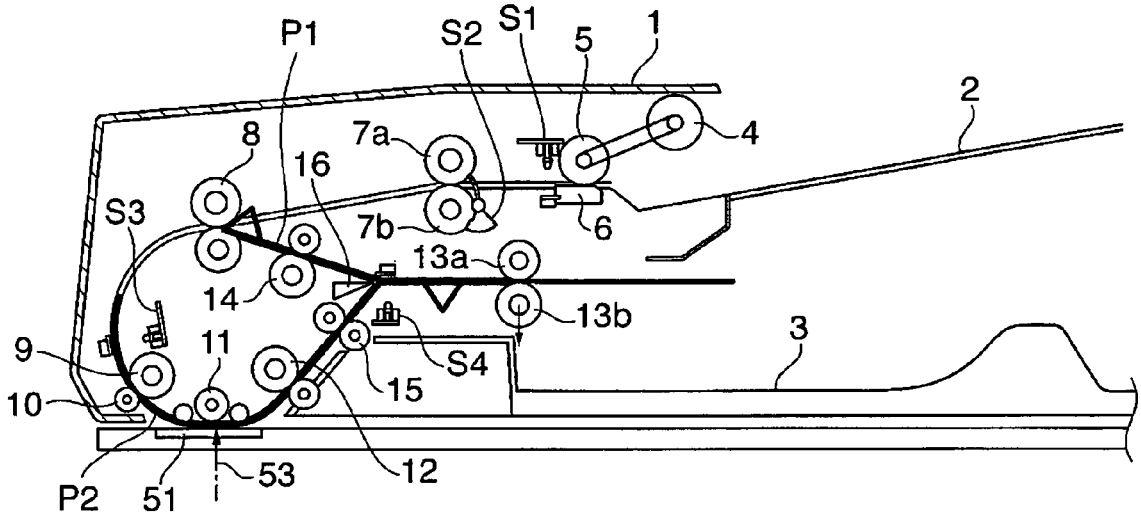
FIGS. 6A and 6B are views showing the originals further conveyed from the positions shown in FIG. 5B.
Figure 6B:
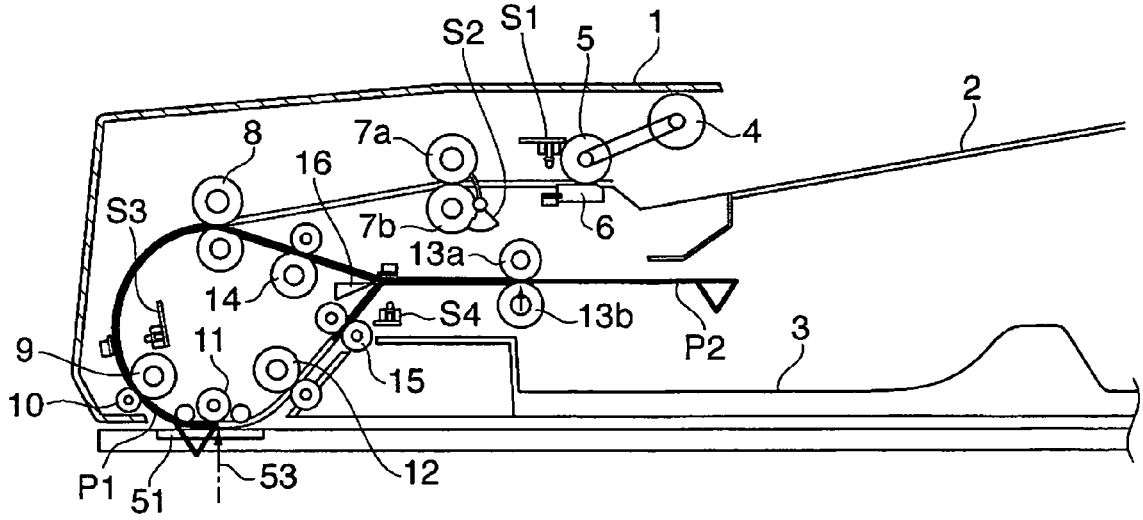
Figure 7A:
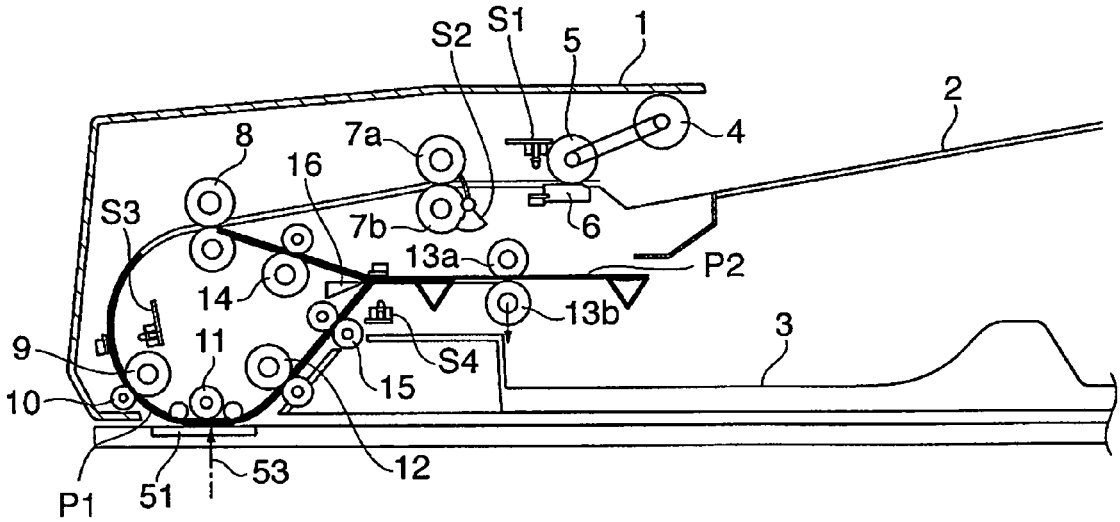
FIGS. 7A and 7B are views showing of the originals further conveyed from the positions shown in FIG. 6B.
Figure 7B:
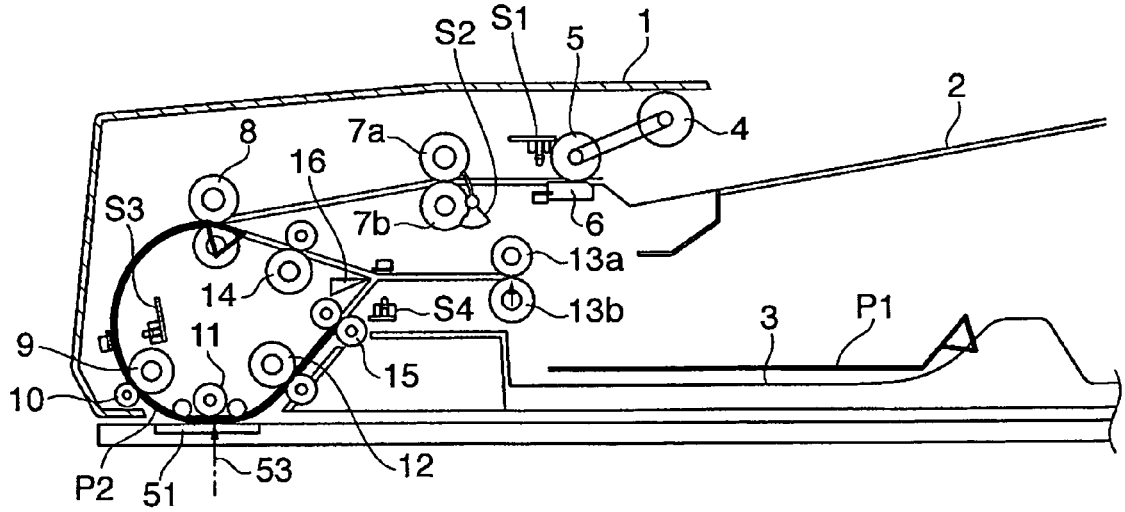

Next, the first original P1 is advanced towards the original discharging section by the inversion flapper 16 and conveyed in the direction of the sheet discharge tray 3 by the nip formed between the discharge/inversion rollers 13*a* and 13*b*. When the trailing edge of the first original P1 passes the discharge sensor S4, the discharge/inversion rollers 13*a* and 13*b* temporarily stop rotating and then are driven in reverse, and the orientation of the inversion flapper 16 is switched. As a result, as shown in FIG. 4B, the first original P1 is switched back, that is, the trailing edge becomes the leading edge, and is conveyed towards the original inverting section (in FIG. 4B, the leading edge before the switchback is indicated by a triangular mark). Before the first original P1 arrives at the second registration rollers 8, the solenoid SL1 is turned off to release the nip between the discharge/inversion rollers 13*a* and 13*b*.

Subsequently, the first original P1 is conveyed towards the second registration rollers 8 by the inverting roller 14. The leading edge (trailing edge before the switchback) of the first original P1 then abuts against the second registration rollers 8, whereby a loop is formed in the original P1 by driving of the inverting roller 14. As a result, skew correction is again performed. After this skew correction, the first original P1 is conveyed to the original conveying section by the second registration rollers 8.

In the original conveying section an exposure operation (scan operation) is performed for the rear surface of the first original P1 at the reading position 53 in a similar manner as for the front surface of the original P1 (see FIG. 4B). At this time, a feeding operation commences for the second original P2 so that the second original P2 arrives at the second registration rollers 8 when a predetermined time elapses after the trailing edge of the first original P1 (leading edge prior to the switchback) passes the second registration rollers 8 (see FIG. 5A). The length of the second original P2 is then determined. In this example, the length of the second original P2 is the same as that of the first original P1. In other words, the length of the second original P2 is shorter than the reference length.

After scanning or reading of the rear surface of the first original P1 is completed, the solenoid SL1 is turned on and the discharge/inversion roller 13*b* is moved upward to form a nip between the discharge/inversion rollers 13*a* and 13*b*. The first original P1 is then conveyed toward the sheet discharge tray 3 by this nip. Simultaneously, the second original P2 is conveyed as it is to the original conveying section and scanning of the front surface of the second original P2 commences (see FIG. 5B).

Thereafter, in order to subject the first original P1 to surface inversion once again, the discharge/inversion rollers 13*a* and 13*b* are driven in reverse after the trailing edge of the first original P1 passes the discharge sensor S4. Thereby, the first original P1 is again switched back and subjected to non-reading conveyance toward the original inverting section.

In this case, after the scanning of the front surface of the second original P2 starts and before the leading edge of the second original P2 arrives at the inversion flapper 16, the first original P1 passes through the inversion flapper 16. Further, before the leading edge of the second original P2 arrives at the discharge/inversion rollers 13*a* and 13*b*, the solenoid SL1 is turned off and the nip in the discharge/inversion rollers 13*a* and 13*b* is released (see FIG. 6A). At this time, the leading edge of the first original P1 has passed through the inverting roller 14. Further, skew correction need not be performed when the first original P1 whose rear surface has been scanned is again subjected to surface inversion.

After completion of scanning the front surface of the second original P2, the solenoid SL1 is turned on and the nip is formed between the discharge/inversion rollers 13*a* and 13*b* before the trailing edge of the second original P2 comes out from the third read rollers 15. As a result, the second original P2 is conveyed in the direction of the sheet discharge tray 3. At the same time, the first original P1 is conveyed to the original conveying section (see FIG. 6B). Then, in order to scan or read the rear surface of the second original P2, after the trailing edge of the original P2 passes the discharge sensor S4, the discharge/inversion rollers 13*a* and 13*b* are rotated in reverse and the second original P2 is switched back and conveyed again to the original conveying section via the original inverting section. At this time, the first original P1 passes through the reading position 53, but an image reading operation is not performed for this original (non-reading conveyance) Further, the second registration rollers 8 must stop rotating upon or before arrival of the leading edge (trailing edge before the switchback) of the second original P2 in order to perform skew correction for the second original P2. Thus, the read motor M2 is halted after the first original P1 is conveyed for a predetermined time after the trailing edge of the first original P1 comes out from the second registration rollers 8. When the leading edge of the second original P2 passes the inverting roller 14, the solenoid SL1 is turned off to release the nip between the discharge/inversion rollers 13*a* and 13*b* (see FIG. 7A).

Next, after skew correction is performed again for the second original P2 at the position of the second registration rollers 8, the read motor M2 is driven to convey the second original P2 to the original conveying section. Simultaneously, the first original P1 is conveyed in the original conveying section. The trailing edge of the second original P2 (leading edge before the switchback) then comes out from the discharge/inversion rollers 13*a* and 13*b*, and the solenoid SL1 is turned on to form the nip between the discharge/inversion rollers 13*a* and 13*b* before the trailing edge of the first original P1 passes through the third read rollers 15. As a result, the first original P1 is discharged onto the sheet discharge tray 3. At the same time, a reading operation is performed for the rear surface of the second original (see FIG. 7B), and after the reading operation finishes, the second original again undergoes surface inversion via the original inverting section, and is then subjected to non-reading conveyance and discharged in a face-down state onto the sheet discharge tray 3.

Figure 8:
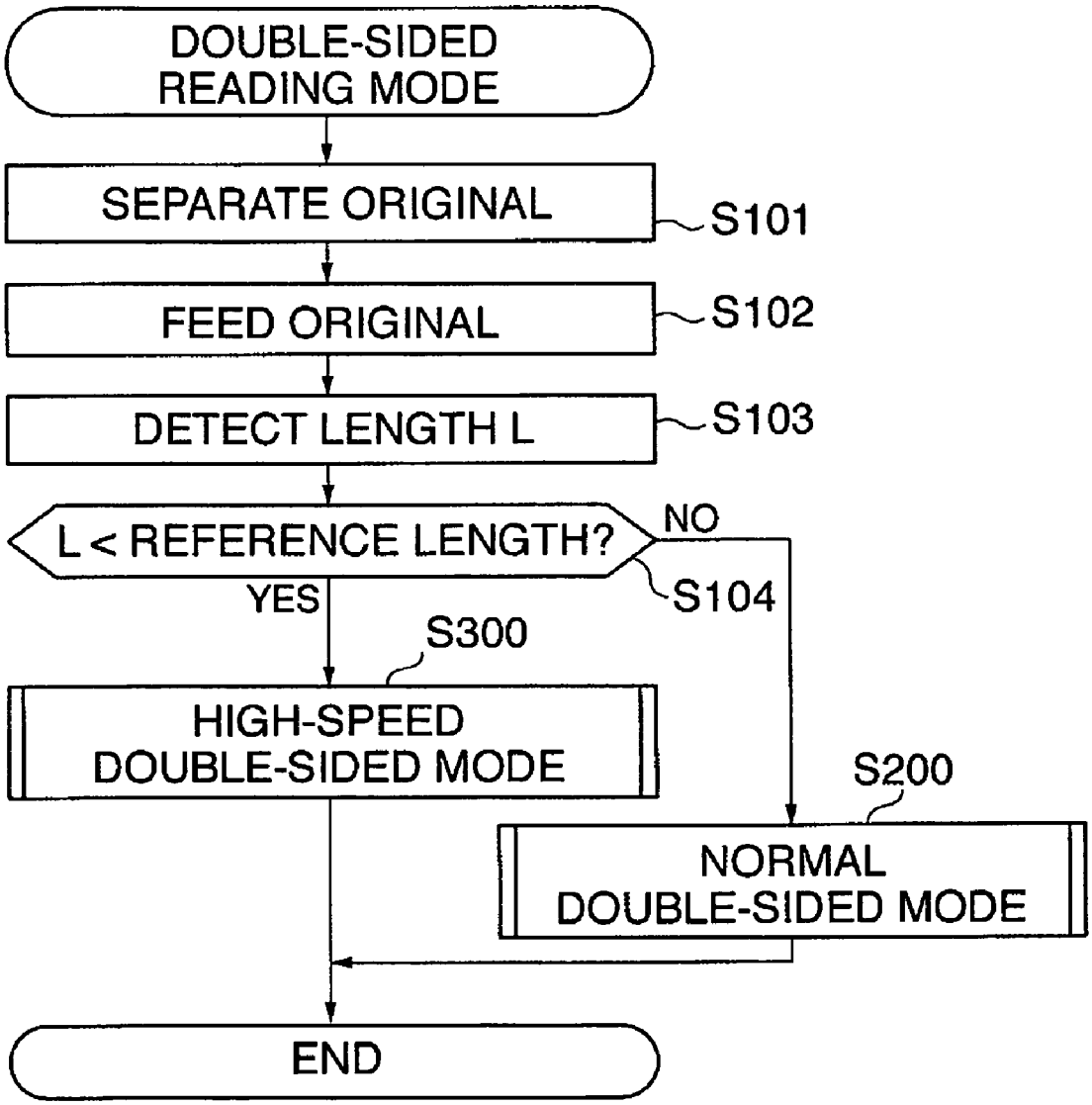
FIG. 8 is a flowchart showing the procedure of an operation in a double-sided reading mode of the automatic document feeder shown in FIG. 2.
Figure 9:
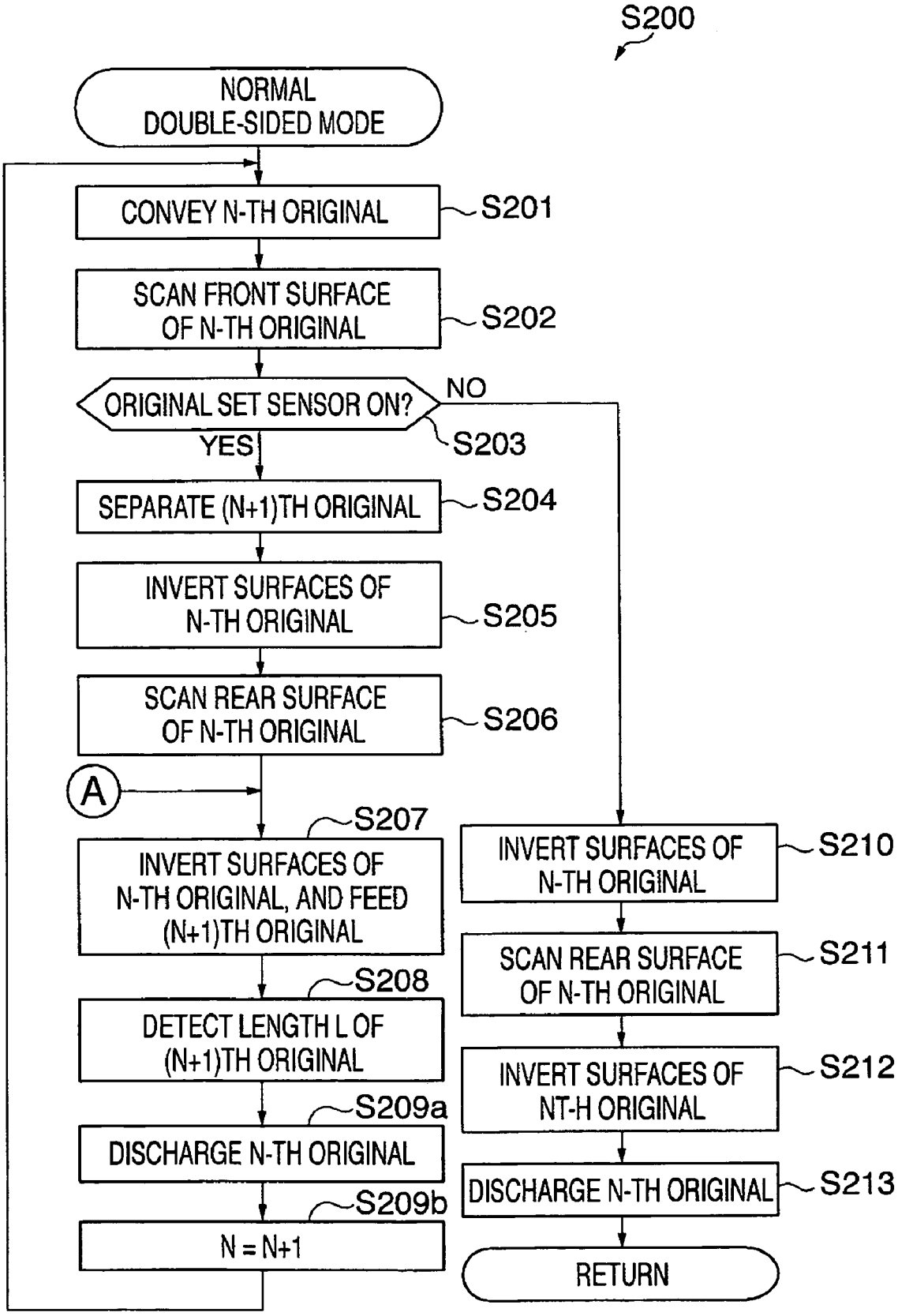
FIG. 9 is a flowchart showing in detail the procedure of an operation in a normal double-sided mode at a step S200 in FIG. 8.
Figure 10:
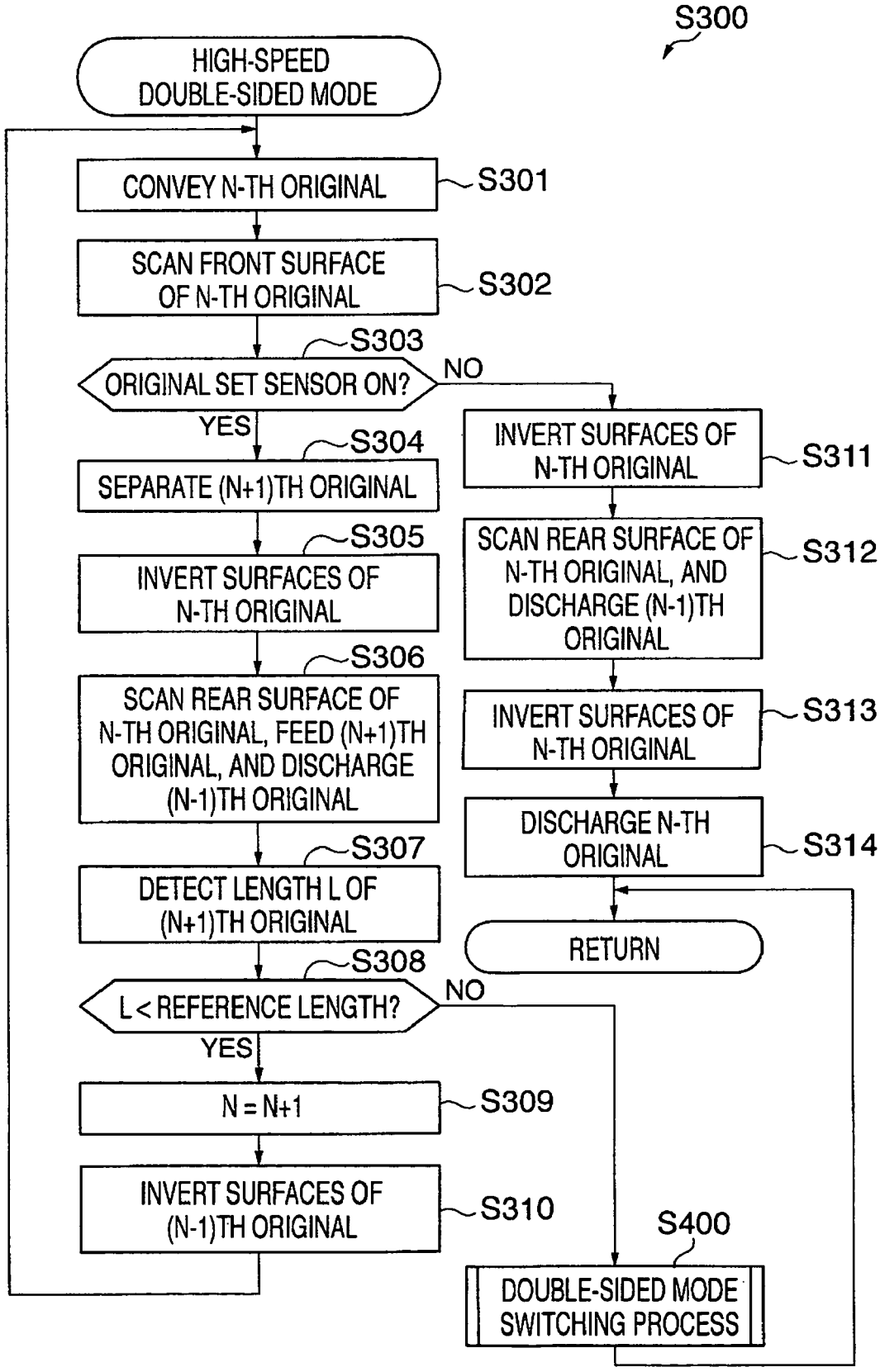
FIG. 10 is a flowchart showing in detail the procedure of an operation in a high-speed double-sided mode at a step S300 in FIG. 8.

Next, the operations of the automatic document feeder 1 shown in FIG. 2 in a double-sided reading mode will be described with reference to FIG. 8 to FIG. 10. FIG. 8 is a flowchart showing the procedure of an operation in the double-sided reading mode in the automatic document feeder 1; FIG. 9 is a flowchart showing in detail the procedure of an operation in the normal double-sided mode at a step S200 in FIG. 8; and FIG. 10 is a flowchart showing in detail the procedure of an operation in the high-speed double-sided mode at a step S300 in FIG. 8. The respective operations shown in these flowcharts are sequentially executed under the control of the CPU 1001 of the CPU circuit 1000 shown in FIG. 3.

First, a bundle of originals to be read or scanned on both sides are stacked on the stacking tray 2 by a user. The user selects the double-sided reading mode and presses a start button (not shown). As shown in. FIG. 8, the $N^{th}$ original to be scanned, for example the first original (N=1), is separated from the bundle of originals (step S101). After skew correction is performed by forming a loop at the position of the first registration rollers 7*a* and 7*b*, the first original (more generally, the $N^{th}$ original) is fed (step S102). Next, as described above, the CPU 1001 counts the clock of the separation and feeding motor M1 from the time the size sensor S1 turns off until the read sensor S3 turns on. Based on the number of counts, the CPU 1001 determines the length L of the original that is being conveyed (step S103).

Next, the CPU 1001 determines whether the original length L is shorter than the reference length (step S104). When the determined original length L is shorter than the reference length, the CPU 1001 selects the high-speed double-sided mode shown in FIG. 10 and executes operations of conveying originals and reading information on the originals in the selected mode (step S300). In contrast, when the original length L is longer than the reference length, the CPU 1001 selects the normal double-sided mode shown in FIG. 9 and executes operations of conveying originals and reading information thereon in that mode (step S200).

In the processing of FIG. 8, the processing of steps S101 to S104 is preferably executed for each original separated from the bundle of originals. When the originals are the same in size, the processing of steps S101 to S104 may be executed for only the first original.

Next, the normal double-sided mode will be described with reference to FIG. 9.

In the normal double-sided mode, as shown in FIG. 9, the $N^{th}$ original, for example the first original (preceding original), is conveyed (step S201), and when the leading edge thereof reaches the reading position 53, a scan or reading operation starts for the front surface of the first original. When the scan operation for the front surface of this preceding original finishes (step S202), the CPU 1001 determines whether or not at least one original including a next original is present on the stacking tray 2 by determining whether the output of the original set sensor S5 is ON or OFF (step S203). When the next original, i.e. the second original ($N+1^{th}$), is present on the stacking tray 2, the second original is separated from the originals on the stacking tray and fed toward the first registration rollers 7*a* and 7*b* (step S204). A loop is then formed in the second original at the first registration rollers 7*a* and 7*b* to perform skew correction for that original, and the second original waits at the position of the first registration rollers 7*a* and 7*b*.

Next, a surface inversion operation is performed to invert the front surface and the rear surface of the first original for which the scan operation for the front surface has been completed (step S205), and a scan operation then starts for the rear surface of the first original (step S206). When scanning of the rear surface of the first original ends, a surface inversion operation is again performed to invert the surfaces of the preceding original. After the lapse of a predetermined time from the time that the trailing edge of the first original passes the second registration rollers 8, the second original is fed so as to reach the second registration rollers 8 (step S207). When the leading edge of the second original is detected by the read sensor S3, the length L of the second original is determined (step S208).

Subsequently, the first original is discharged onto the sheet discharge tray 3 (step S209*a*). When discharge of the first original is completed, the original conveying number N is incremented by 1 (step S209*b*), whereby the second original (more generally, $N+1^{th}$ original), which has been the next original, is handled as the preceding original. A scan operation then starts for the front surface of the second ($N+1^{th}$) original (step S201), and the operations in the steps S201 to S209*b* are repeated in a similar manner.

In the step S203, when the original set sensor S5 is OFF and the CPU 1001 determines there is no next original, a surface inversion operation is carried out for the first original for which an operation to scan the front surface thereof has been completed (step S210), and a scan operation is started for the rear surface of the first original (step S211). When scanning of the rear surface of the first original ends, a surface inversion is again performed for the first original (step S212). Thereafter, the first original undergoes non-reading conveyance and is discharged (step S213), thus completing the operation.

Next, processing in the high-speed double-sided mode will be described referring to FIG. 10. In this example, a case will be described in which a-second (N=2) original is conveyed as the preceding original.

The second original is conveyed as the preceding original (step S301), and when the leading edge thereof arrives at the reading position 53, a scan or reading operation starts for the front surface of the second original (step S302). When the scan operation ends for the front surface of the original, the CPU 1001 determines whether or not a next original ($N+1^{th}$ original) is present on the stacking tray 2 by determining whether the output of the original set sensor S5 is ON or OFF (step S303). When the next original, i.e. a third original, exists, an operation commences to separate the third original from the bundle of originals, and the leading edge of this original abuts against the first registration rollers 7*a* and 7*b* (step S304). A loop is then formed in the third original to perform skew correction for that original, and the third original waits at the position of the registration rollers 7*a* and 7*b*.

Figure 16:
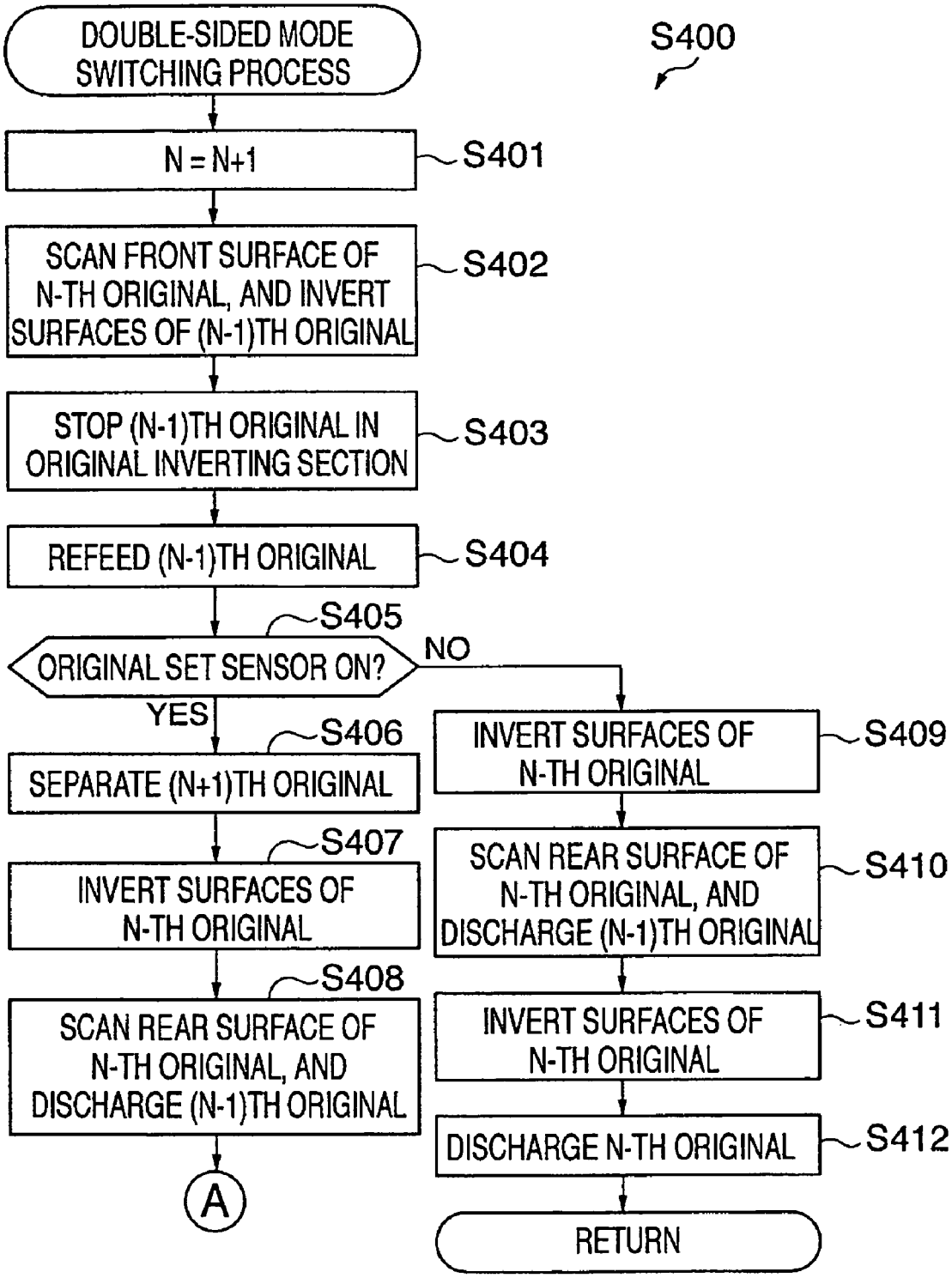
FIG. 16 is a flowchart showing in detail the procedure of a double-sided mode switching process at a step S400 in FIG. 10.

Next, a surface inversion operation is performed for the second original for which a scan operation for the front surface has been completed (step S305), and a scan operation starts for the rear surface of the second original (step S306). During the scanning of the rear surface of the second original, the first ($N-1^{th}$) original having undergone the surface inversion again is subjected to non-reading conveyance and discharged, and the third original is fed (step S306). When the leading edge of the third original is detected by the read sensor. S3, the length L of the third original is determined (step S307). The CPU 1001 then determines whether or not the determined length L of the third original is shorter than the reference length (step S308). In this example, when the original length L is shorter than the reference length, the original conveying number N is incremented by 1 (step S309). As a result, the second ($N^{th}$) original that has been the preceding original is handled as an original to be subjected to non-reading conveyance, and the third ($N+1^{th}$) original that has been the next original is handled as the preceding original. The second original is then subjected to surface inversion again (step S310), and the operations of the steps S301 to S310 are repeated. In contrast, when the length L of the third original is longer than the reference length, a double-sided mode switching process is performed as shown in FIG. 16, which is described later (step S400).

When it is determined at the step S303 that the original set sensor S5 is OFF and thus there is no next original, the second original for which scanning of the front surface has been finished in the step S302 (usually, the final original of the bundle of originals) undergoes surface inversion (step S311) to begin scanning of the rear surface of the second original. While scanning of the rear surface of the second original is underway, the first ($N-1^{th}$) original having undergone surface inversion again is subjected to non-reading conveyance and discharged (step S312). Thereafter, the second original undergoes surface inversion again (step S313), and after this surface inversion, the second original is subjected to non-reading conveyance and discharged (step S314). Usually, the processing of steps S311 to S314 is executed for the final original and the preceding original thereto. The present operation then ends.

Next, the double-sided mode switching process will be described with reference to FIG. 11A to FIG. 16. FIG. 11A to FIG. 15B are views showing an example of how originals separated from a bundle of originals including originals of different lengths are conveyed in the high-speed double-sided mode of FIG. 10. FIG. 16 is a flowchart showing in detail the procedure of the double-sided mode switching process at the step S400 in FIG. 10.

In the present embodiment, as shown in FIG. 8, when the length L of a first original is shorter than the reference length in a double-sided reading mode, conveying of originals starts according to the high-speed double-sided mode. In the high-speed double-sided mode, when the length of any of the originals from the second original onward is equal to or greater than the reference length, a double-sided mode switching process is performed. In the high-speed double-sided mode according to the present embodiment, it is possible to simultaneously and sequentially feed three originals P1, P2 and P3 into the conveying paths of the automatic document feeder 1. In this example, a case is described in which the length L of a second original P2 among a bundle of three originals is equal to or greater than the reference length.

Conveying of the three double-sided originals stacked in the stacking tray 2 is started by the automatic document feeder 1. After the front surface of the first original P1 is scanned or read as shown in FIG. 4A, the first original P1 is subjected to surface inversion as shown in FIG. 4B, and conveyed to the reading position 53 again. The second original P2 waits at the position of the first registration rollers 7*a* and 7*b*.

Figure 11A:
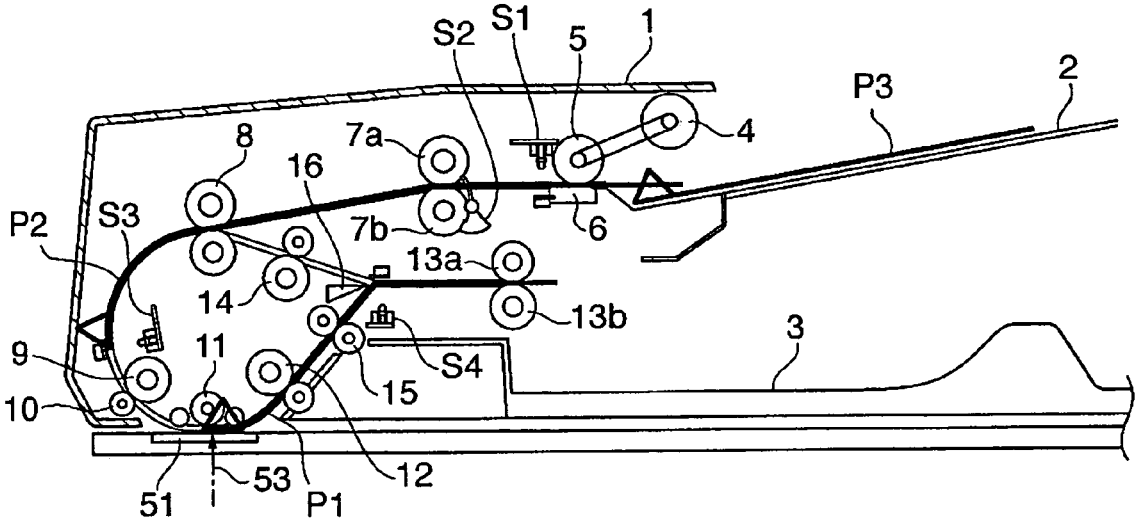
FIGS. 11A and 11B are views showing an example of how originals separated from a bundle of originals including originals of different lengths are conveyed in the high-speed double-sided mode shown in FIG. 10.
Figure 11B:
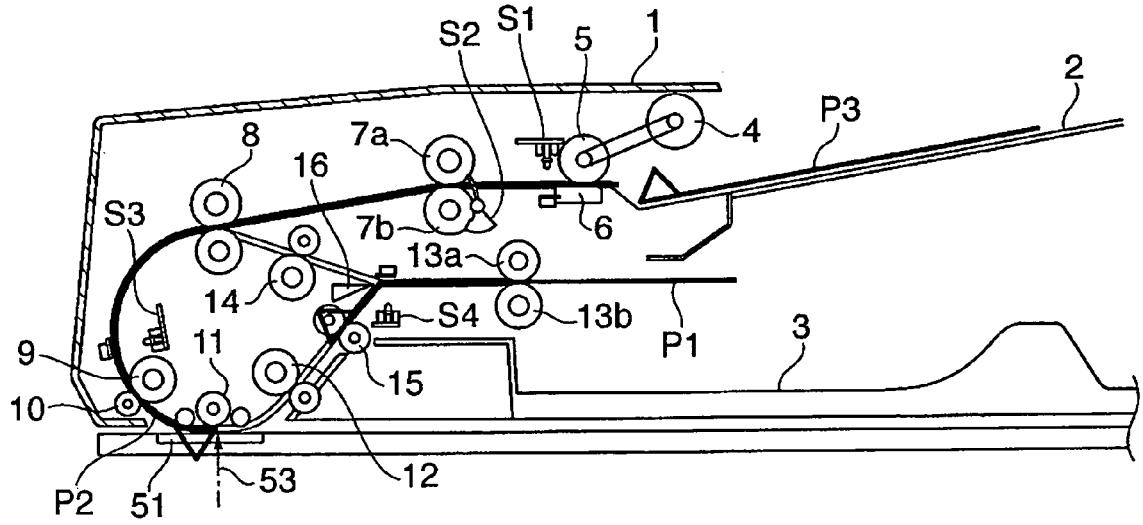

Subsequently, the second original P2 is fed by the first registration rollers 7*a* and 7*b* so that it arrives at the second registration rollers 8 following the lapse of a predetermined time after the trailing edge of the first original P1 passes the second registration rollers 8. When the leading edge of the second original P2 arrives at the position of the read sensor S3, the length of the original P2 is determined. When the original length is equal to or greater than the reference length (FIG. 11A), after completion of scanning of the rear surface of the first original P1, the solenoid SL1 is turned on and the discharge/inversion roller 13*b* moves upward. Thereby, the first original P1 is conveyed towards the sheet discharge tray 3 via the nip formed between the discharge/inversion rollers 13*a* and 13*b*. At the same time, scanning of the front surface of the second original P2 starts (FIG. 11B).

After the trailing edge of the first original P1 passes the discharge sensor S4, the discharge/inversion rollers 13*a* and 13*b* are temporarily stopped and then rotatably driven in reverse. Thereby, the first original P1 is conveyed towards the inverting roller 14, and before the first original P1 arrives at the second registration rollers 8, the solenoid SL1 is turned off to release the nip in the discharge/inversion rollers 13*a* and 13*b*. The first original P1 is then conveyed in the direction of the second registration rollers 8 by the inverting roller 14 (see FIG. 12A). In this case, in order to convey the first original P1 to the second registration rollers 8, the inverting roller 14 is rotatably driven in reverse after the lapse of a predetermined time (predetermined distance) from the time that the size sensor S1 detects that the trailing edge of the second original P2 has passed the second registration rollers 8. More specifically, after the trailing edge of the second original P2 passes the second registration rollers 8, the first original P1 is subjected to non-reading conveyance by the second registration rollers 8 so as to be conveyed towards the original conveying section once more. At this time, skew correction need not be performed for the first original P1.

Figure 12A:
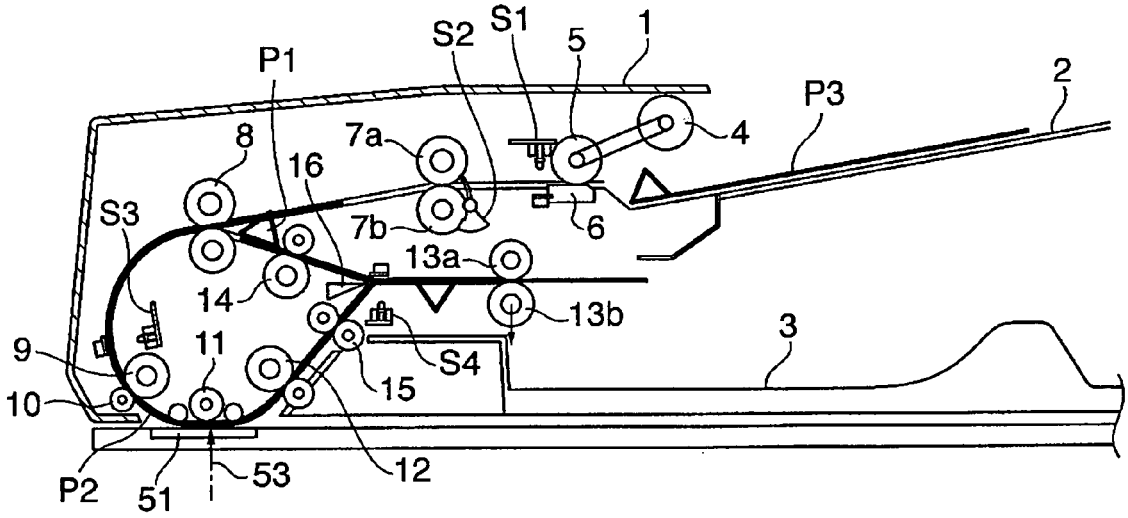
FIGS. 12A and 12B are views showing the originals further conveyed from the positions shown in FIG. 11B.
Figure 12B:
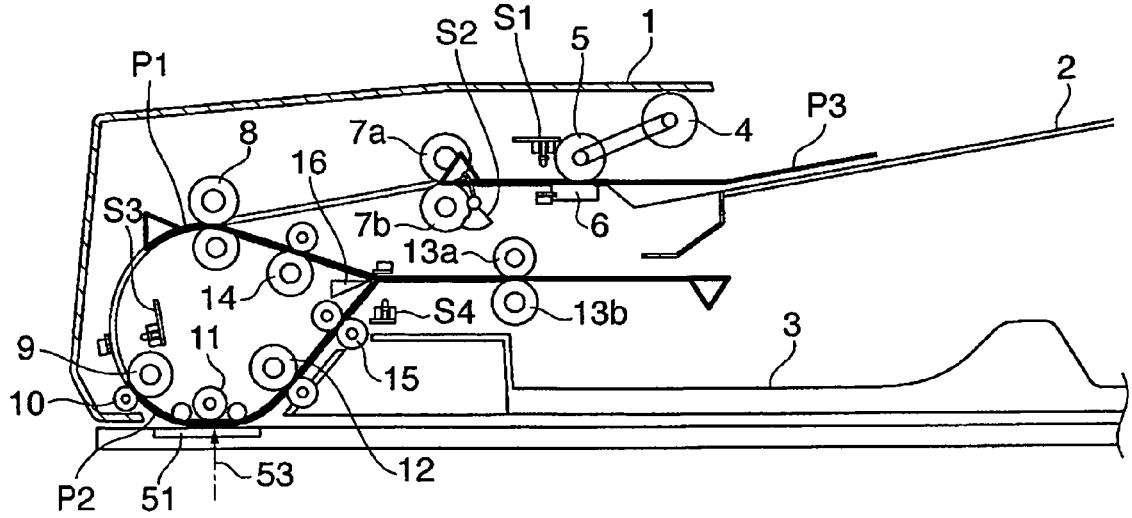

When the trailing edge of the second original P2 passes the position of the read sensor S3, feeding of the third original P3 starts. The third original P3 likewise undergoes a skew correction operation at the position of the first registration rollers 7*a* and 7*b*, and then waits in that position (FIG. 12B).

Figure 13A:
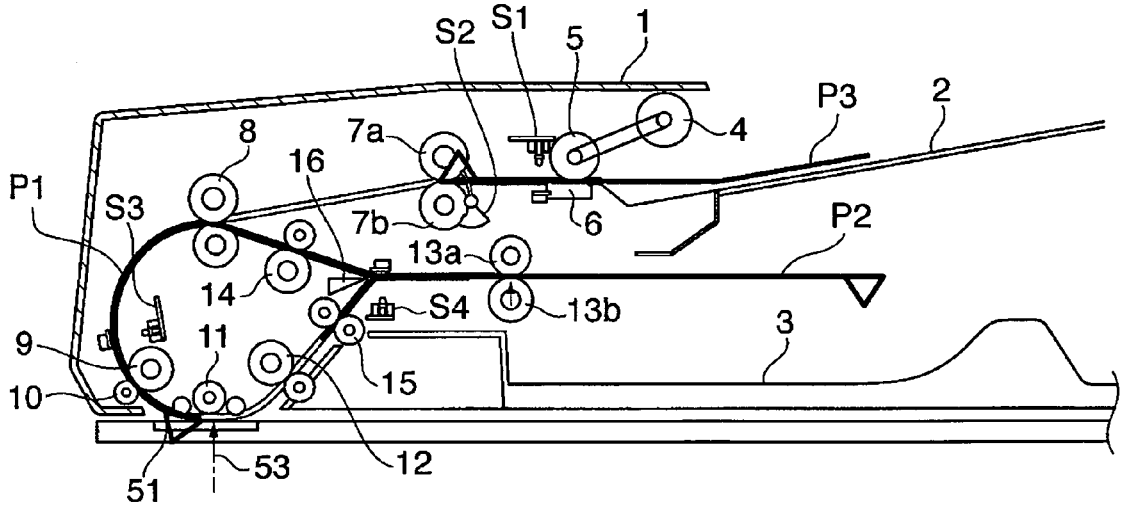
FIGS. 13A and 13B are views showing the originals further conveyed from the positions shown in FIG. 12B.

After scanning of the front surface of the second original P2 ends, before the trailing edge of the second original P2 comes out from the third read rollers 15, the solenoid SL1 is turned on to form the nip between the discharge/inversion rollers 13*a* and 13*b*, whereby the second original P2 is conveyed towards the original discharging section. At the same time, the first original P1 is conveyed to the original conveying section (FIG. 13A). In order to scan or read the rear surface of the second original P2, after the trailing edge of the original passes the discharge sensor S4, the second original P2 is conveyed towards the original conveying section via the original inverting section. At this time, the first original P1 passes the reading position 53 without being scanned (non-reading conveyance). Further, since the second registration rollers 8 must stop rotating before the arrival of the leading edge of the second original P2 in order to perform skew correction for the second original P2 prior to scanning the rear surface of that original, the second registration rollers 8 are stopped after the first original P1 has been conveyed for a predetermined time (predetermined distance) after the trailing edge of the first original P1 comes out from the second registration rollers 8.

Figure 13B:
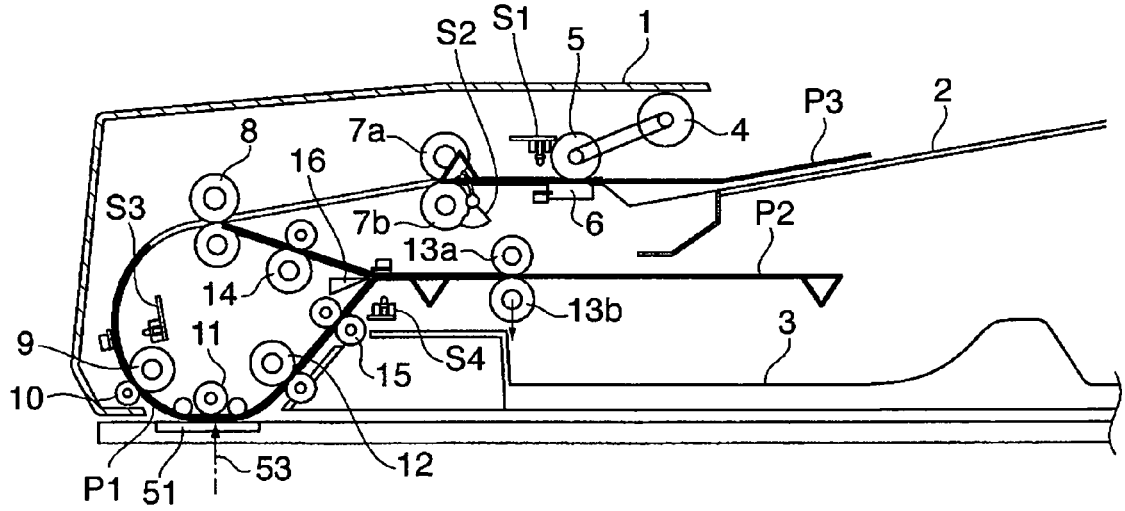
Figure 14A:
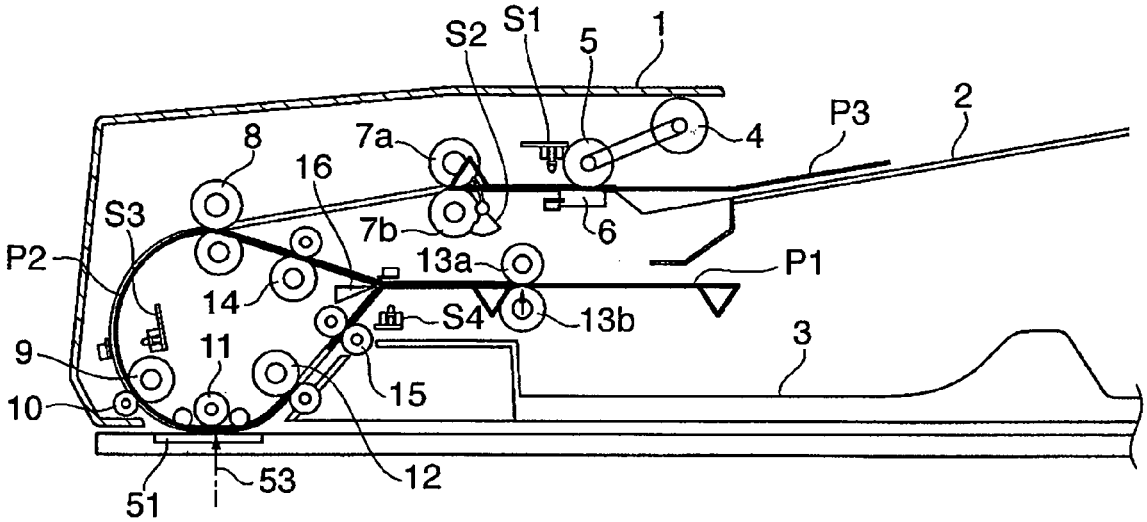
FIGS. 14A and 14B are views showing the originals further conveyed from the positions shown in FIG. 13B.

When the leading edge of the second original P2 passes the inverting roller 14, the solenoid SL1 is turned off to release the nip formed between the discharge/inversion rollers 13*a* and 13*b* (FIG. 13B). After the second original P2 undergoes skew correction at the position of the second registration rollers 8, it is again fed to the original conveying section by the second registration rollers 8. Simultaneously, the first original P1 is conveyed to the original discharging section. When the trailing edge of the second original P2 comes out from the discharge/inversion rollers 13*a* and 13*b*, and before the trailing edge of the first original P1 passes through the third read rollers 15, the solenoid SL1 is turned on to move the discharge/inversion roller 13*b* upward and release the nip between the discharge/inversion rollers 13*a* and 13*b* (FIG. 14A).

Figure 14B:
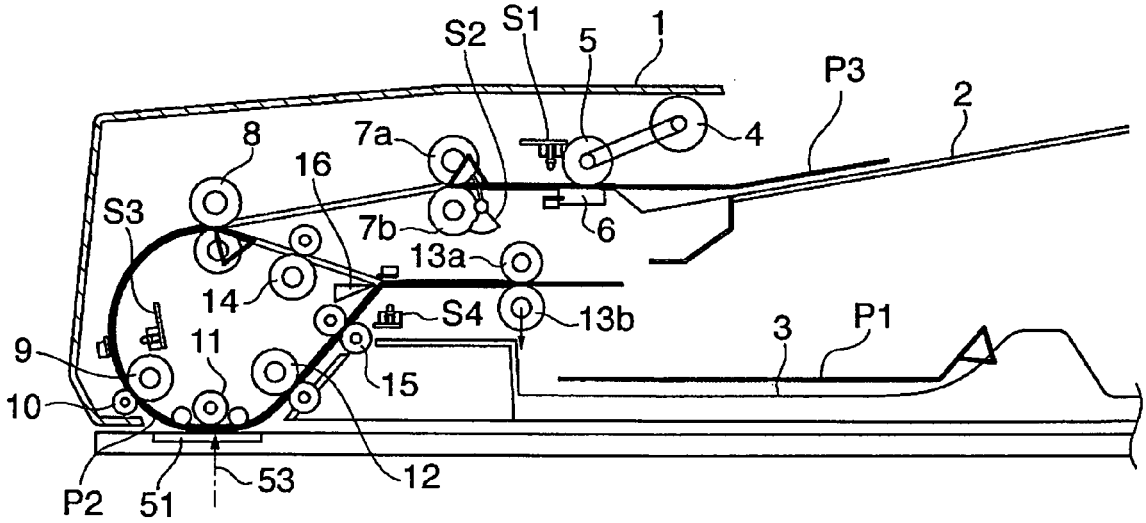

Next, the first original P1 is discharged onto the sheet discharge tray 3. At the same time, scanning of the rear surface of the second original P2 is carried out. At this time, the third original P3 is still in a waiting state at the position of the first registration rollers 7*a* and 7*b* (FIG. 14B).

Figure 15A:
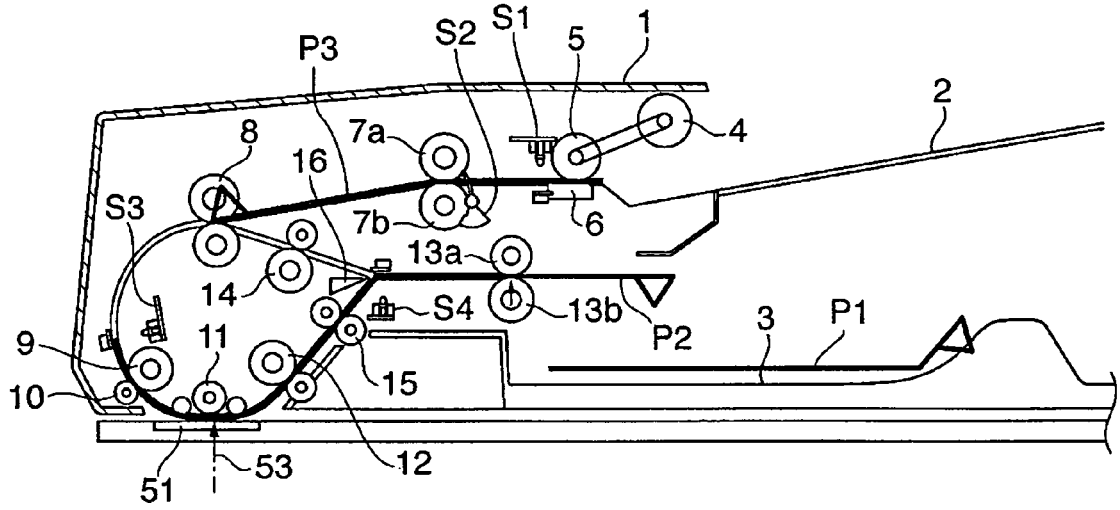
FIGS. 15A and 15B are views showing the originals further conveyed from the positions shown in FIG. 14B.

After scanning of the rear surface of the second original P2 ends, the second original P2 is conveyed to the original inverting section to undergo surface inversion again, and after the trailing edge of this original passes the discharge sensor S4, non-reading conveyance thereof to the original conveying section is started (not shown). After the lapse of a predetermined time after the trailing edge of the second original P2 passes the second registration rollers 8 during the non-reading conveyance, the third original P3 is fed by the first registration rollers 7*a* and 7*b* so as to arrive at the second registration rollers 8 (FIG. 15A).

Figure 15B:
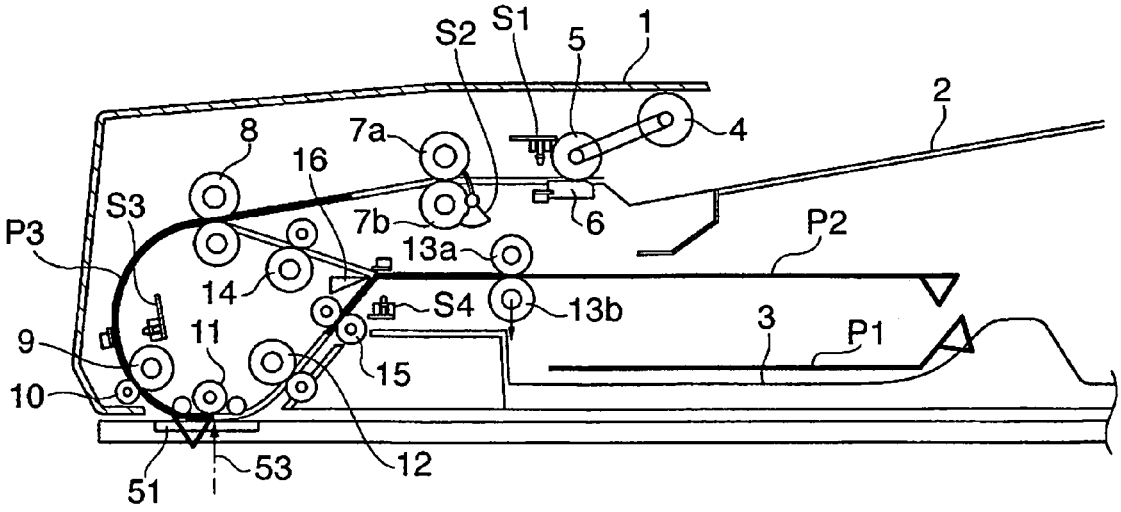

Subsequently, scanning of the front surface of the third original P3 is performed (FIG. 15B). Simultaneously, the second original P2 is discharged onto the sheet discharge tray 3. When the trailing edge of the third original P3 passes the discharge sensor S4, the discharge/inversion rollers. 13*a* and 13*b* are temporarily stopped and then rotatably driven in reverse in order to perform surface inversion of the third original P3. A skew correction operation is then performed for the third original P3, which is then conveyed to the original conveying section (not shown). Next, scanning of the rear surface of the third original P3 is carried out. Thereafter, in order to perform surface inversion of this original once again, it is conveyed to the original conveying section via the original inverting section (non-reading conveyance). Having undergone surface inversion, the third original P3 is discharged in a face-down state onto the sheet discharge tray 3 (not shown). The present operation then ends.

According to the above operation, since scanning of the front surface of the third original P3 is performed after waiting for non-reading conveyance of the second original P2 whose length is longer than the reference length, the original conveying operation for the third original P3 is the same as in the normal double-sided mode.

Next, the procedure of the double-sided mode switching process of the present embodiment will be described with reference to FIG. 16.

This process is executed at the step S400 of FIG. 10 when it is determined during the operation in the high-speed double-sided mode (step S300 of FIG. 10) that the length of the $N+1^{th}$ original determined in step S307 is longer than the reference length (NO at step S308). In this example, a case is described in which the length L of a third ($N+1^{th}$) original is longer than the reference length.

As shown in FIG. 16, first, in a step S401, the value of the original conveying number N is incremented by 1 (N=N+1). In this example, the incremented value of the original conveying number N is equal to "3". When the third original is fed and reaches the reading position 53, an operation is started to scan or read the front surface of that original, and at the same time, the second original for which scanning of the rear surface thereof has been completed is switched back and subjected to surface inversion (step S402). The second ($N-1^{th}$) original is then stopped at a position short of the second registration rollers 8 inside the original inverting section (step S403). When the trailing edge of the third original passes the second registration rollers 8 and a scan operation starts for the front surface of the third original, the second original is again conveyed to the original conveying section to thereby start non-reading conveyance (step S404).

When the scanning operation ends for the front surface of the third original, it is determined whether or not a next original is present on the stacking tray 2 by determining whether the output of the original set sensor S5 is ON or OFF (step S405). When a fourth ($N+1^{th}$) original exists, the fourth original is separated and fed, and made to wait at the position of the first registration rollers 7*a* and 7*b* (step S406).

After scanning of the front surface of the third original ends, the third original is subjected to surface inversion (step S407), undergoes skew correction, and is then conveyed to the original conveying section by the second registration rollers 8. Scanning or reading of the rear surface of the third original is then started. During the scanning of the rear surface of the third original, the second original ($N-1^{th}$ or preceding original) is discharged (step S408). At this time, feeding of the fourth original has not yet started (see FIG. 14B). Thereafter, the process proceeds to the step S207 of FIG. 9, whereby the third original is again subjected to surface inversion and the fourth original is fed so as to arrive at the second registration rollers 8 after the lapse of a predetermined time from the time that the trailing edge of the third original passes the second registration rollers 8 (see FIG. 15A). The normal double-sided mode is then actuated for the fourth and subsequent originals (see FIG. 15B).

When it is determined that the original set sensor S5 is off in the step S405 and thus a next original does not exist, after completion of scanning of the front surface of the third original, the third original undergoes surface inversion (step S409), and scanning of the rear surface of that original starts. During the scanning of the rear surface of the third original, the second ($N-1^{th}$) original is discharged (step S410). Thereafter, the third original again undergoes surface inversion (step S411), after which it is subjected to non-reading conveyance and discharged onto the sheet discharge tray 3 (step S412). The present operation then ends.

Thus, according to the present embodiment, it is possible to prevent the occurrence of jams that would be caused when a bundle of originals, in which one or more long length originals having lengths equal to or greater than a predetermined reference length and one or more short length originals having lengths shorter than the reference length are mixed, are conveyed in the high-speed double-sided mode. Furthermore, it is possible to reduce production costs and provide a compact construction without making the driving system complicated in structure.

Although in the above described embodiment, it has been described that three originals can simultaneously and sequentially be fed into the conveying paths of the automatic document feeder in the high-speed double-sided mode, the number of originals fed thereinto may be equal to or greater than four depending on the reference length and the original length.

Although in the present embodiment, an example in which the automatic document feeder 1 is mounted on a copier as an image processing apparatus has been described, it is possible to mount this kind of automatic document feeder on a different kind of image processing apparatus, for example, a scanner. In that case also, a similar effect as the effect described above can be obtained.

It is to be understood that the object of the present invention may also be accomplished by supplying a system or apparatus with a storage medium (or a recording medium) in which a program code of software which realizes the functions of the above described embodiment is stored, and causing a computer (or CPU or MPU) of the system or apparatus to read out and execute the program code stored in the storage medium.

In this case, the program code itself read out from the storage medium realizes the functions of the above described embodiment, and hence the program code and a storage medium in which the program code is stored constitute the present invention.

Examples of the storage medium for supplying the program code include a floppy (registered trademark) disk, a hard disk, a magneto-optical disk, an optical disk such as a CD-ROM, a CD-R, a CD-RW, a DVD-ROM, a DVD-RAM, a DVD-RW or a DVD+RW, a magnetic tape, a nonvolatile memory card, and a ROM. Alternatively, the program code may be downloaded from another computer, a database, or the like, not shown, that is connected to the Internet, a commercial network, a local area network, or the like.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

Further, the form of the program may be an object code, a program code executed by an interpreter, or script data supplied to an OS.

This application claims the benefit of Japanese Application No. 2005-133318, filed Apr. 28, 2005, which is hereby incorporated by reference herein in its entirety.

What is claimed is:

1. An automatic document feeder that sequentially conveys a bundle of originals including at least a preceding original and a next original to be conveyed subsequent to the preceding original and each having a first side and a second side, the feeder comprising:

a conveying path for sequentially conveying the originals in a conveying direction from a sheet feeding position, at which conveying of the original stars, to a stacking position, at which the originals are stacked, via a reading position, at which reading is sequentially performed for the originals, the reading position being between the sheet feeding position and the stacking position;

a reconveying path that branches from said conveying path at a branching position, between the reading position and the stacking position, and merges with said conveying path at a merging position, between the sheet feeding position and the reading position, for feeding, at the merging position, a respective one of the originals that has passed through the reading position to said conveying path;

a controlling unit that controls conveyance of the originals to carry out a first conveyance for sequentially conveying the originals along said conveying path from the sheet feeding position to the branching position to read the first side of each of the originals at the reading position, a second conveyance for conveying a respective one of the originals, for which the first conveyance has been carried out, to the branching position via said reconveying path and said conveying path to read the second side of the respective one original at the reading position, and a non-reading conveyance for conveying the respective one original, for which the second conveyance has been carried out, to the stacking position via said reconveying path and said conveying path, including through the reading position;

a selecting unit that selects one of a first mode in which the preceding original is conveyed by the first conveyance, the second conveyance, and the non-reading conveyance, and the first conveyance for the next original is started after the preceding original passes the reading position during the non-reading conveyance, or a second mode in which the preceding original is conveyed by the first conveyance and the second conveyance, and the first conveyance for the next original is started in advance of starting the non-reading conveyance for the preceding original; and an original length detecting unit that detects a length of each of the originals in the conveying direction, wherein said selecting unit selects the first mode to switch over from the second mode to the first mode when a length in the conveying direction of the preceding original being conveyed in the second mode is determined to be equal to or greater than a predetermined length based on a detection result of said original length detecting unit.

2. The automatic document feeder according to claim 1, wherein said selecting unit selects the first mode when a length in the conveying direction of a top original of the bundle of originals is determined to be shorter than the predetermined length based on the detection result of said original length detecting unit, and selects the second mode when the length of the top original is determined to be equal to or greater than the predetermined length.

3. An image processing apparatus comprising:

an automatic document feeder according to claim 1; and an original reading unit that performs reading of each original of the bundle of originals supplied from said automatic document feeder.

4. An original conveying method for an automatic document feeder that sequentially conveys a bundle of originals including at least a preceding original and a next original to be conveyed subsequent to the preceding original and each having a first side and a second side, and comprises a conveying path for sequentially conveying the originals in a conveying direction from a sheet feeding position, at which conveying of the originals starts, to a stacking position, at which the originals are stacked, via a reading position, at which reading is sequentially performed for the originals, the reading position being between the sheet feeding position and the stacking position, and a reconveying path that branches from the conveying path at a branching position, between the reading position and the stacking position, and merges with the conveying path at a merging position, between the sheet feeding position and the reading position, for feeding, at the merging position, a respective one of the originals that has passed through the reading position to said conveying path, the original conveying method comprising:

a controlling step of controlling conveyance of the originals to carry out a first conveyance for sequentially conveying the originals along the conveying path from the sheet feeding position to the branching position to read the first side of each of the originals at the reading position, a second conveyance for conveying a respective one of the originals, for which the first conveyance has been carried out, to the branching position via the reconveying path and the conveying path to read the second side of the respective one original at the reading position, and a non-reading conveyance for conveying the respective one original, for which the second conveyance has been carried out, to the stacking position via the reconveying path and the conveying path, including through the reading position;

a selecting step of selecting one of a first mode in which the preceding original is conveyed by the first conveyance, the second conveyance, and the non-reading conveyance, and the first conveyance for the next original is started after the preceding original passes the reading position during the non-reading conveyance, or a second mode in which the preceding original is conveyed by the first conveyance and the second conveyance, and the first conveyance for the next original is started in advance of starting the non-reading conveyance for the preceding original; and an original length detecting step of detecting a length of each of the originals in the conveying direction, wherein said selecting step selects the first mode to switch over from the second mode to the first mode when a length in the conveying direction of the preceding original being conveyed in the second mode is determined to be equal to or greater than a predetermined length based on a detection result in said original length detecting step.

5. The original conveying method for an automatic document feeder according to claim 4, wherein said selecting step selects the first mode when a length in the conveying direction of a top original of the bundle of originals is determined to be shorter than the predetermined length based on the detection result in said original length detecting step, and selects the second mode when the length of the top original is determined to be equal to or greater than the predetermined length.

6. A computer-readable medium storing a computer program for controlling an automatic document feeder that sequentially conveys a bundle of originals including at least a preceding original and a next original to be conveyed subsequent to the preceding original and each having a first side and a second side, and comprises a conveying path for sequentially conveying the originals in a conveying direction from a sheet feeding position, at which conveying of the originals starts, to a stacking position, at which the originals are stacked, via a reading position, at which reading is sequentially performed for the originals, the reading position being between the sheet feeding position and the stacking position, and a reconveying path that branches from the conveying path at a branching position, between the reading position and the stacking position, and merges with the conveying path at a merging position, between the sheet feeding position and the reading position, for feeding, at the merging position, a respective one of the originals that has passed through the reading position to said conveying path, the computer program comprising:

a control module for controlling conveyance of the originals to carry out a first conveyance for sequentially conveying the originals along the conveying path from the sheet feeding position to the branching position to read the first side of each of the originals at the reading position, a second conveyance for conveying a respective one of the originals, for which the first conveyance has been carried out, to the branching position via the reconveying path and the conveying path to read the second side of the respective one original at the reading position, and a non-reading conveyance for conveying the respective one original, for which the second conveyance has been carried out, to the stacking position via the reconveying path and the conveying path, including through the reading position;

a selecting module for selecting one of a first mode in which the preceding original is conveyed by the first conveyance, the second conveyance, and the non-reading conveyance, and the first conveyance for the next original is started after the preceding original passes the reading position during the non-reading conveyance, or a second mode in which the preceding original is conveyed by the first conveyance and the second conveyance, and the first conveyance for the next original is started in advance of starting the non-reading conveyance for the preceding original; and an original length detecting module for determining a length of each of the originals in the conveying direction, wherein said selecting module selects the first mode to switch over from the second mode to the first mode when a length in the conveying direction of the preceding original being conveyed in the second mode is determined to be equal to or greater than a predetermined length in said original length detecting module.

7. The computer-readable medium according to claim 6, wherein said selecting module selects the first mode when a length in the conveying direction of a top original of the bundle of originals is determined to be shorter than the predetermined length in said original length detecting module, and selects the second mode when the length of the top original is determined to be equal to or greater than the predetermined length.

* * * * *